US007870970B2

(12) United States Patent
Fisk

(10) Patent No.: US 7,870,970 B2
(45) Date of Patent: Jan. 18, 2011

(54) COLLAPSIBLE CONTAINER

(75) Inventor: Frank Michael Fisk, Queensland (AU)

(73) Assignee: Collapsible Containers Pty Ltd., West Australia (AU)

( * ) Notice: Subject to any disclaimer, the term of this patent is extended or adjusted under 35 U.S.C. 154(b) by 568 days.

(21) Appl. No.: 11/661,411

(22) PCT Filed: Sep. 1, 2005

(86) PCT No.: PCT/AU2005/001333

§ 371 (c)(1),
(2), (4) Date: Feb. 28, 2007

(87) PCT Pub. No.: WO2006/024104

PCT Pub. Date: Mar. 9, 2006

(65) Prior Publication Data

US 2008/0029510 A1 Feb. 7, 2008

(30) Foreign Application Priority Data

Sep. 1, 2004 (AU) ..... 2004904967

(51) Int. Cl.
*B65D 8/14* (2006.01)

(52) U.S. Cl. ..... 220/7; 220/6; 220/4.33; 220/4.29; 220/4.28

(58) Field of Classification Search ..... 220/6, 220/4.33, 4.29, 4.28, 23.83, 1.5, 23.86; 217/43 R, 217/47, 15, 36, 12 R
See application file for complete search history.

(56) References Cited

U.S. PATENT DOCUMENTS 3,398,850 A * 8/1968 Kennard ..... 220/6
3,570,698 A * 3/1971 Dougherty ..... 220/1.5
3,765,556 A * 10/1973 Baer ..... 220/1.5
3,781,947 A * 1/1974 Germer ..... 24/287
4,314,686 A * 2/1982 Marz ..... 248/346.3
4,388,995 A * 6/1983 Ahn ..... 220/7
4,577,772 A * 3/1986 Bigliardi ..... 220/1.5
4,917,256 A * 4/1990 Kruck et al. ..... 220/4.28
4,942,971 A * 7/1990 Neugebauer et al. ..... 220/1.5
5,076,457 A * 12/1991 Marovskis ..... 220/6
5,190,179 A * 3/1993 Richter et al. ..... 220/6
5,294,027 A * 3/1994 Plastina ..... 224/553
5,415,311 A * 5/1995 Coogan ..... 220/6
5,494,182 A * 2/1996 Clive-Smith ..... 220/6
5,865,334 A * 2/1999 Ruiz et al. ..... 220/6
5,897,012 A * 4/1999 Sortwell ..... 220/4.28
6,024,223 A * 2/2000 Ritter ..... 206/600
6,163,913 A * 12/2000 DiSieno et al. ..... 14/71.3
6,269,963 B1 * 8/2001 Hall ..... 220/1.5

(Continued)

*Primary Examiner*—Anthony Stashick
*Assistant Examiner*—Kareen Rush
(74) *Attorney, Agent, or Firm*—Young & Thompson

(57) ABSTRACT

A collapsible container includes a base, a top, and opposed side covers arranged between the base and the top. The side covers have a lower section frame pivotally connected to the base and a top section frame pivotally connected to the top, and a central hinge arrangement configured so that the top section frame is pivotally movable relative to the lower section frame. The side covers can thus be selectively positioned between an erected position and a collapsed position. In the erected position, the container presents an interior space. End covers are arranged to be pivotally movable between an upright position for covering respective open ends, and a down position for allowing the side covers to be movable to the collapsed position.

53 Claims, 32 Drawing Sheets

U.S. PATENT DOCUMENTS 6,299,011 B1 * 10/2001 Rosenfeldt ..... 220/4.29
6,415,938 B1 * 7/2002 Karpisek ..... 220/1.5
6,520,364 B2 * 2/2003 Spykerman et al. ..... 220/6
6,792,892 B2 * 9/2004 Craig ..... 119/502
6,793,084 B1 * 9/2004 Wunsch ..... 220/1.5
7,137,522 B2 * 11/2006 Dubois ..... 220/6
7,526,890 B1 * 5/2009 Keng et al. ..... 42/136

* cited by examiner

COLLAPSIBLE CONTAINER

TECHNICAL FIELD OF THE INVENTION

This invention relates generally to a container for holding items therein and is collapsible when empty.

BACKGROUND OF THE INVENTION

Containers are used for holding items such as goods, in storage and while being transported to destinations by vehicles including trucks, trains, aeroplanes and ships. The costs of storage and transportation of the goods in containers are based on the respective volumes occupied by the containers. Accordingly, the costs are the same even if the containers are empty or not filled to capacity.

Emptied containers generally need to be stored before they are reemployed to transport goods. Many of the containers need to be transported empty to different locations where goods are to be loaded. To reduce storage and transportation costs for the empty containers, it is desirable to have containers that can be collapsed during storage and in transit. Collapsible containers have previously been proposed. However, the prior art collapsible containers known to the inventor do not meet the stringent container standards set by the transportation authorities and insurance bodies. The standards require the containers to pass various structural strength tests such as shock tests in relation dropping from a height above floor level, tipping, rolling, stacking, racking, etc. None of the known collapsible containers pass all these tests.

The standards also require the containers to be spray or water proof.

OBJECT OF THE PRESENT INVENTION

An object of the present invention is to alleviate or to reduce to a certain level one or more of the above prior art disadvantages.

OUTLINE OF THE PRESENT INVENTION

In one aspect therefore the present invention resides in a collapsible container comprising a base structure, a top structure, opposed side covers arranged between the base structure and the top structure, each said side covers having a lower section frame pivotally connected to said base structure and a top section frame pivotally connected to said top structure, and a central hinge arrangement configured so that the top section frame is pivotally movable relative to the lower section frame, whereby the side covers are selectively positionable between an erected position in which the top structure is remote from the base structure and a collapsed position in which the top structure is at or adjacent to the base structure, in the erected position the container presenting an interior space between the base and top structures and between opposed open ends of the container, end covers arranged to be pivotally movable between an upright position for covering respective open ends, and a down position for allowing the side covers to be movable to the collapsed position, the central hinge arrangement being associated with central load distribution means arranged so that in the erected position load is distributed between the upper and lower section frames of each side cover, and a tensioning arrangement for tensioning the side covers and/or the end covers in the erected position.

In preference, the central hinge arrangement for each side cover includes at least one pair of first central hinge elements fixed to the top section frame and a second hinge element fixed to the lower section frame, and a bridging member provided for the or each pair of the first and second central hinge elements, the or each bridging member having compatible hinge elements at ends thereof and the compatible hinge elements are arranged to cooperate with respective paired first and second hinge elements so that the top section frame is pivotally movable relative to the lower section frame.

The central load distribution means may be associated with the or each of said paired first and second hinge elements so as to distribute load between the top and lower section frames when the container is in the erected position. It is preferable that the central load distribution means include a central load transfer member for the or each of said paired first and second hinge elements, and the central load transfer member has opposed ends, one end thereof being fixed to or integrally formed with one of said top and lower section frames, and the other end thereof being arranged to engage the other of said top and lower section frames when the container is in the erected position.

In preference, the tensioning arrangement is arranged to tension the side covers in a substantially vertical direction along the side covers, and in a substantially horizontal direction along the side covers.

The tensioning arrangement may include first tensioning means having one or more paired central tensioning elements arranged to tension one or each side cover in a substantially vertical direction. The one or more paired central tensioning elements are respectively fixed to the top and lower section frames and are configured to engage each other to thereby tension said one or each side cover.

It is further preferred that the first tensioning means have one or more paired upper tensioning elements and/or one or more paired lower tensioning elements for one or each side cover. The one or more paired upper tensioning elements are respectively fixed to the top section frame and the top structure, and are configured to engage each other to thereby tension said one or each side cover. The one or more paired lower tensioning elements are respectively fixed to the lower section frame and the base structure, and are configured to engage each other to thereby tension said one or each side cover.

The first tensioning means may have sets of said tensioning elements spacedly arranged along each side cover, and each set includes one pair of the central tensioning elements and one pair of the upper and/or lower tensioning elements.

It is preferred that the one or more paired central tensioning elements are preferably arranged so that the tension on said one or each side cover is variable. It is preferred that one of said paired central tensioning elements is a projection, and the other of said paired central tensioning elements is rotatable and has a recess with a cam surface configured to engage the projection when it is in the recess. The cam surface is shaped to vary said tension when said other of said paired central tensioning elements is rotated. The projection may be in the form of a pin or a hook.

The lower and/or the upper paired tensioning elements may similarly configured to vary tension on the side covers.

Preferably, the central load transfer member is configured to extend between ends of a respectively side cover. The tensioning arrangement may be arranged to be selectively positioned to maintain the central load transfer member in engagement the other of said first and second top and lower section frames when the container is in the erected position. As such, the side covers become fully covered solid walls in the erected position.

The top section frame of each side cover may have a load bar arranged to engage a clamping plate extending from the bridging member when the container is in the erected position. The load bar may also engage the central load transfer member while the container is in the erected position.

Preferably, each side cover has one or more panels arranged to cover each of the top and lower section frames. Advantageously, the one or more panels having a corrugated or wavy profile.

The top structure may have a top skirting along each side thereof and the top skirting is arranged in pivotal connection with the top section frame. Preferably, the container has at least one top hinge arranged to pivotally connect the top skirting with the top section frame. Top load distribution means is advantageously associated with the at least one top hinge to distribute load between the top skirt and the top section frame. The top load distribution means may have one or more top load bearing bars associated with the or each said at least one top hinge. The tensioning means may also have the upper paired tensioning elements arranged to lock one or more of the one or more top load bearing bars in position. The top section frame may have at least one upper gusset and the at least one top hinge having a first top hinge element fixed to respective upper gusset and a compatible second top hinge element fixed to the top skirting.

The base structure may have a base skirting along each side thereof and the base skirting is arranged in pivotal connection with the lower section frame. Preferably, the container has at least one lower hinge arranged to pivotally connect the base skirting with the lower section frame. Base load distribution means is advantageously associated with the at least one lower hinge to distribute load between the base skirt and the lower section frame. The base load distribution means may have one or more lower load bearing bars associated with the or each said at least one lower hinge. The tensioning means may also have the paired lower tensioning elements arranged to lock one or more of the one or more lower load bearing bars in position. The lower section frame may have at least one lower gusset and the at least one lower hinge having a first lower hinge element fixed to respective upper gusset and a compatible second lower hinge element fixed to the base skirting.

Advantageously, the central hinge arrangement includes a plurality of paired first and second hinge elements, and the container includes a number of top hinges and a like number lower hinges arranged in substantial alignment with corresponding paired first and second hinge elements. This arrangement provides further improvement to load distribution as load is shared more evenly across the side covers.

It is preferred that each side cover includes a sealing arrangement having top sealing means for sealing between the top structure and the top section frame, and lower sealing means for sealing between the base structure and the lower section frame. The central hinge arrangement may also has central sealing means for sealing between the top and lower section frames.

The base structure and/or the top structure may have pockets configured to receive forks of a lifting device. Preferably each said pockets are formed of a hollow tubular member extending between the base/top skirtings. More preferably, the base/top structure includes reinforcement means fixed to the base/top skirtings and arranged to reinforce structural strength of the hollow tubular members.

Desirably, the base structure has a number of spaced cross members with ends thereof fixed to the base skirtings and a floor supported by the base cross members.

The container may have an open or closed top structure. The close top structure preferably has a number of spaced cross members with ends thereof fixed to the top skirtings and a top cover supported by the top cross members.

The container may have base corner fittings and top corner fittings arranged respectively at corners of the base structure and the top structure. It is preferred that each of the top and base corner fittings has at least one hole arranged to receive a container locking pin for locking to another container thereon or thereunder.

Preferably, the end covers are pivotally connected to the base structure and arranged to be pivotally movable between the down position at which the end covers resting on the base structure and the upright position at which the end covers closing the open ends. More preferably, at least one of the end covers is biassed to move to its down position and/or upright position.

Each said end covers may have spaced posts. One end cover may have a cover member spanning the posts, and the other end cover may have one or more doors arranged between the posts. In preference, the tensioning arrangement further includes second tensioning means arranged to tension each side cover in a substantially horizontal direction traversing the end covers. In one form, the second tensioning means includes one or more paired tensioning elements, one element of a paired tensioning elements being fixed to one of said posts and the other element of the paired tensioning elements being fixed to one of said side covers, and arranged to engage with each other when the end covers are in the upright position, whereby the side covers are in tension. Each tensioning element on the posts may have a cam surface arranged to be positionable to engage the other element on the side cover in the engaged position. As for the tensioning elements of the first tensioning means, the paired tensioning elements may be configured to be adjustable for varying tension on the side walls.

It is further preferred that each post includes a flange formed with the one tensioning elements, and each said side cover includes end flanges formed with said other tensioning elements of the paired tensioning elements. Said one element(s) may be configured as an aperture(s) and said other tensioning element(s) may be configured a hook(s) arranged to fit in the corresponding aperture(s) when the end covers are in the upright position.

Each of the posts have a lower end and an upper end. Preferably, the second tensioning means includes a load bearing plate arranged at the lower end of each post and a positioning element arranged at the upper end of each post. The load bearing plates of the posts are configured to engage with corresponding side covers when the end covers are in the upright position. The positioning elements of the posts are configured to engage with a complimentary positioning elements on the top structure when the end covers are in the upright position. The load bearing plates and the positioning elements are arranged to place the side covers in tension in said vertical direction.

One or both of the end covers may include a door selectively positionable between an open position for accessing interior of the container and a closed position for closing access to the interior.

The top structure may also have pockets configured to receive forks of a lifting device. Preferably each said pockets of the top structure are formed of a hollow tubular member extending between the top skirtings. More preferably, the top structure includes reinforcement means fixed to the top skirtings and arranged to reinforce structural strength of the hollow tubular members.

The top structure may be configured with a slight bow when the side covers are in the collapsed position, and the tensioning arrangement is arranged to cause the top structure to be substantially level when the side covers are under tension. Typically, for a standard shipping container, the bow is in the order of 1 to 3 milliliter.

Each said post may also be configured with a slight bow when in the lowered position, and the tensioning arrangement is arranged to cause the posts to be substantially straight when they are under tension.

BRIEF DESCRIPTION OF THE DRAWINGS

In order that the present invention can be more readily understood and be put into practical effect reference will now be made to the accompanying drawings which illustrate non-limiting embodiments of the present invention and wherein.

DETAILED DESCRIPTION OF THE INVENTION

Figure 1:
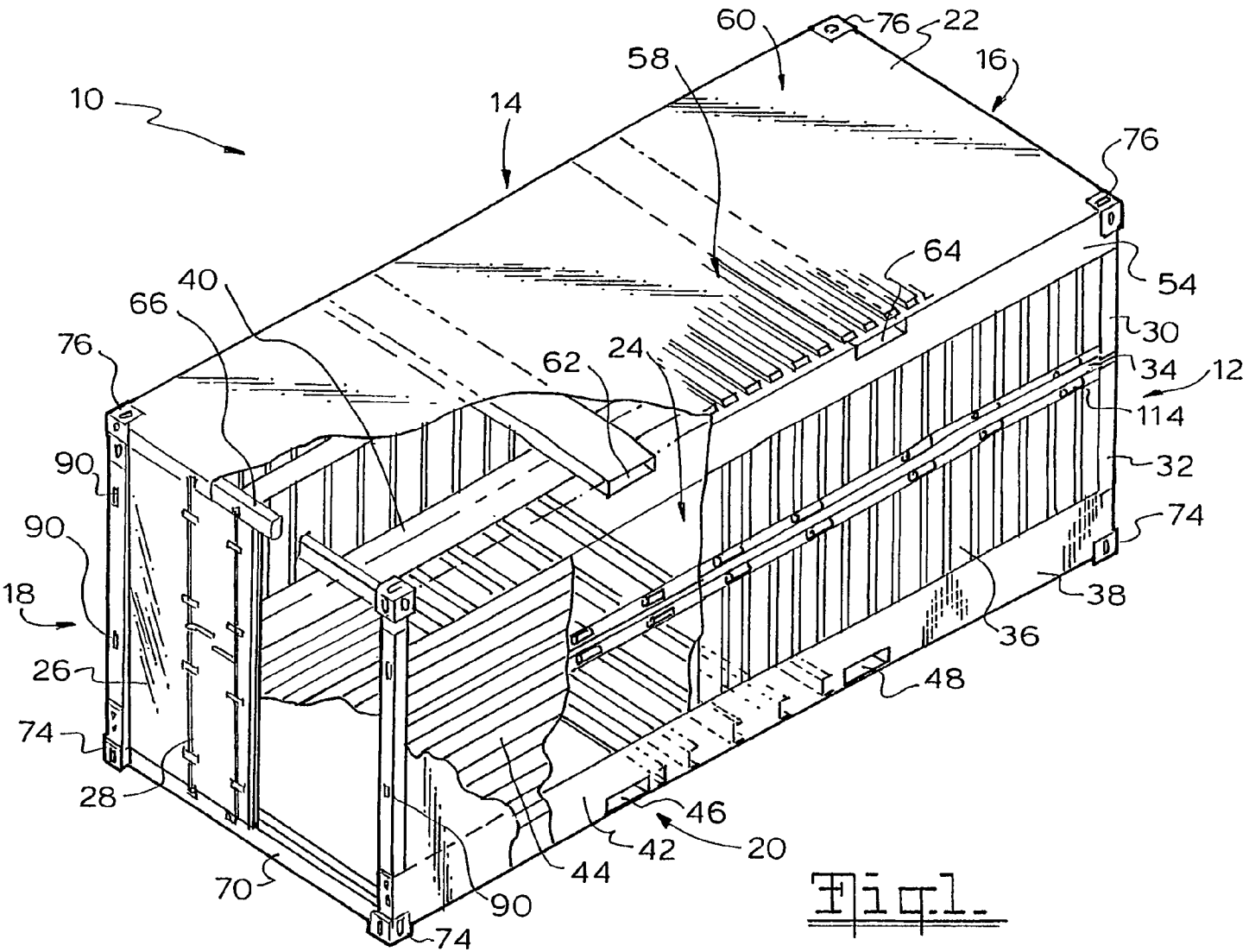
FIG. 1 is a perspective view of an embodiment of the collapsible container according to the present invention.

Referring initially to FIG. 1, there is shown an embodiment of a collapsible container 10 according to the present invention. The container 10 as shown has opposed side covers 12 and 14, opposed end walls 16 and 18, a base structure 20 and a top structure 22. The container as shown is in its fully erected state and has an interior space 24 for holding cargoes. The side cover 12, end cover 18 and the top structure 22 are partially cut away to reveal the interior space 24. In this embodiment, the end cover 18 has two hinged doors 26 (one only shown) with locking bars 28 for locking the doors in the closed position. The bars 28 can be unlocked to open the doors 26 for accessing the interior space 24.

Figure 2:
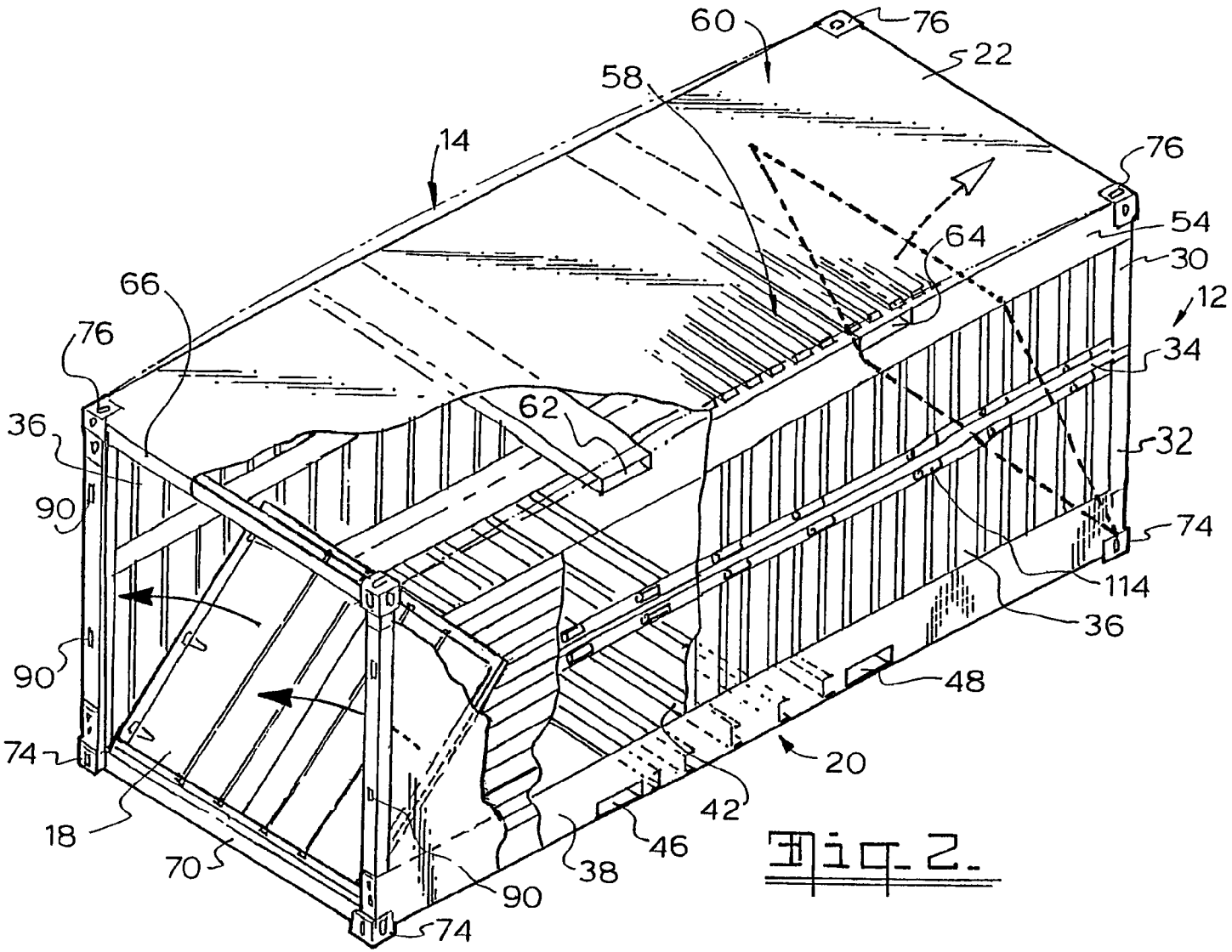
FIG. 2 shows the container of FIG. 1 with one of the end covers being moved to an upright position.
Figure 8:
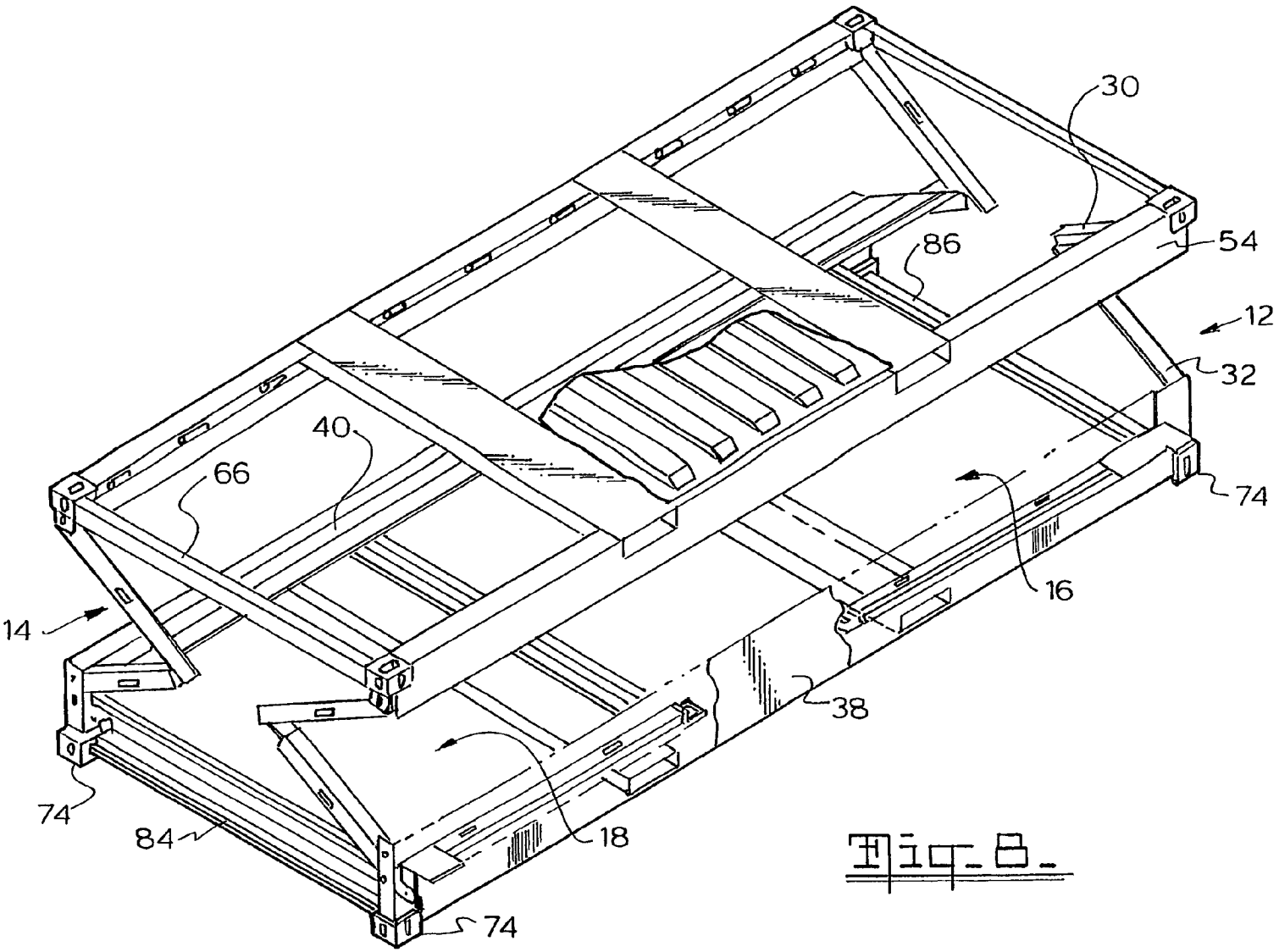
FIG. 8 shows the container of FIG. 1 being in position towards its fully collapsed state.

The end covers 16 and 18 are pivotally connected to the base structure 20. These end covers can be moved to a down position resting on the floor structure 20 as shown in FIG. 8 and to an upright position as shown in FIG. 1. FIG. 2 shows the end covers 16 and 18 being moved to their respective upright position. As shown in dot-dash lines in FIG. 2, the top structure 22 has a slightly bow when the side covers 12 and 14 are untensioned. When the side covers are under tension, the top structure 22 would level out. Thus the top structure 22 would also apply a tension force to the side covers 12 and 14.

Each of the side covers 12 and 14 are formed of a top section frame 30 and a lower section frame 32. A central hinge arrangement 34 pivotally connect the section frames 30 and 32 of each of the side covers 12 and 14. Corrugated steel panels 36 are secured to the section frames 30 and 32 by any known securing means such as welding, or with screws or bolts.

Figure 3:
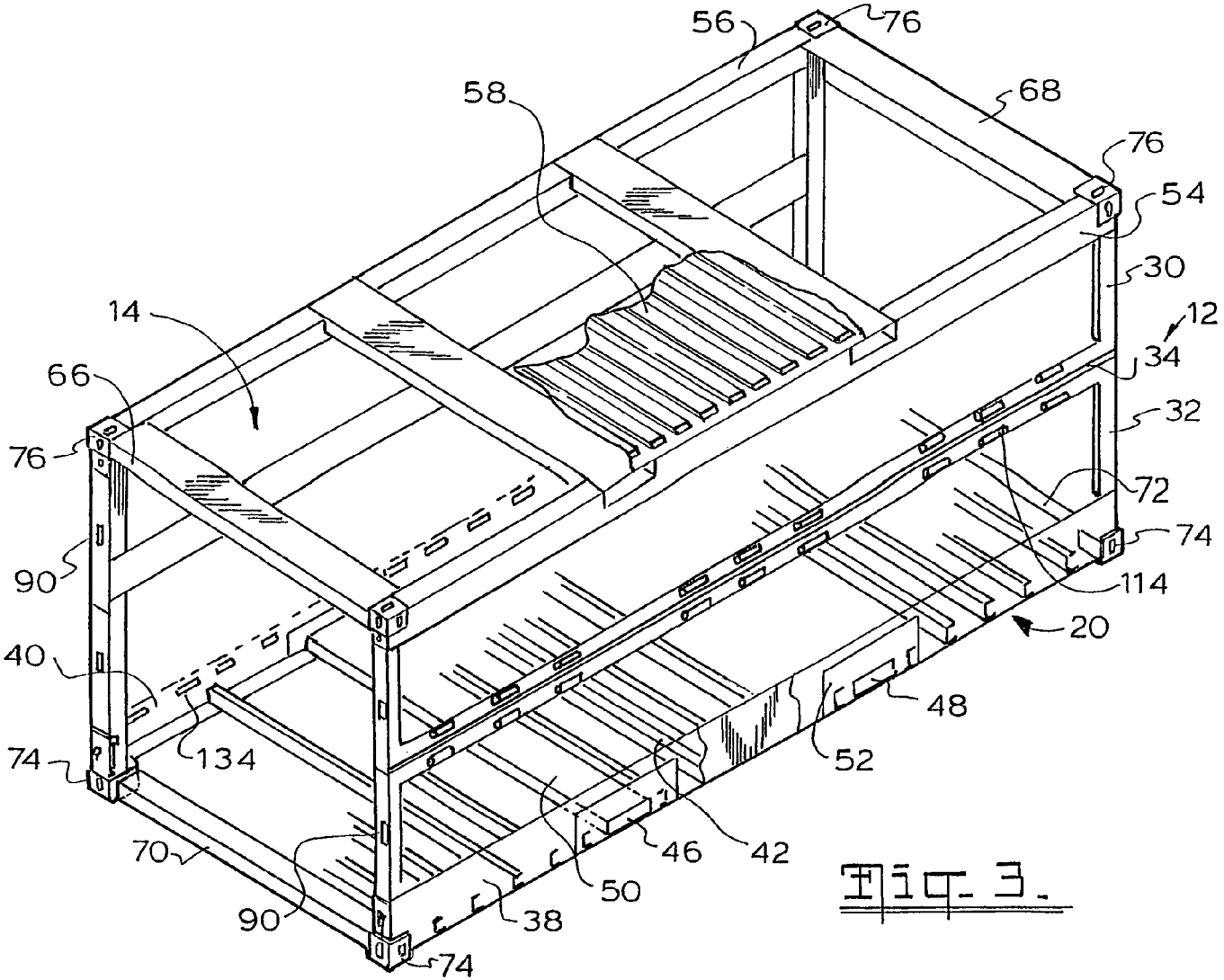
FIG. 3 shows the container of FIG. 1 with its side panels and end covers removed.
Figure 4:
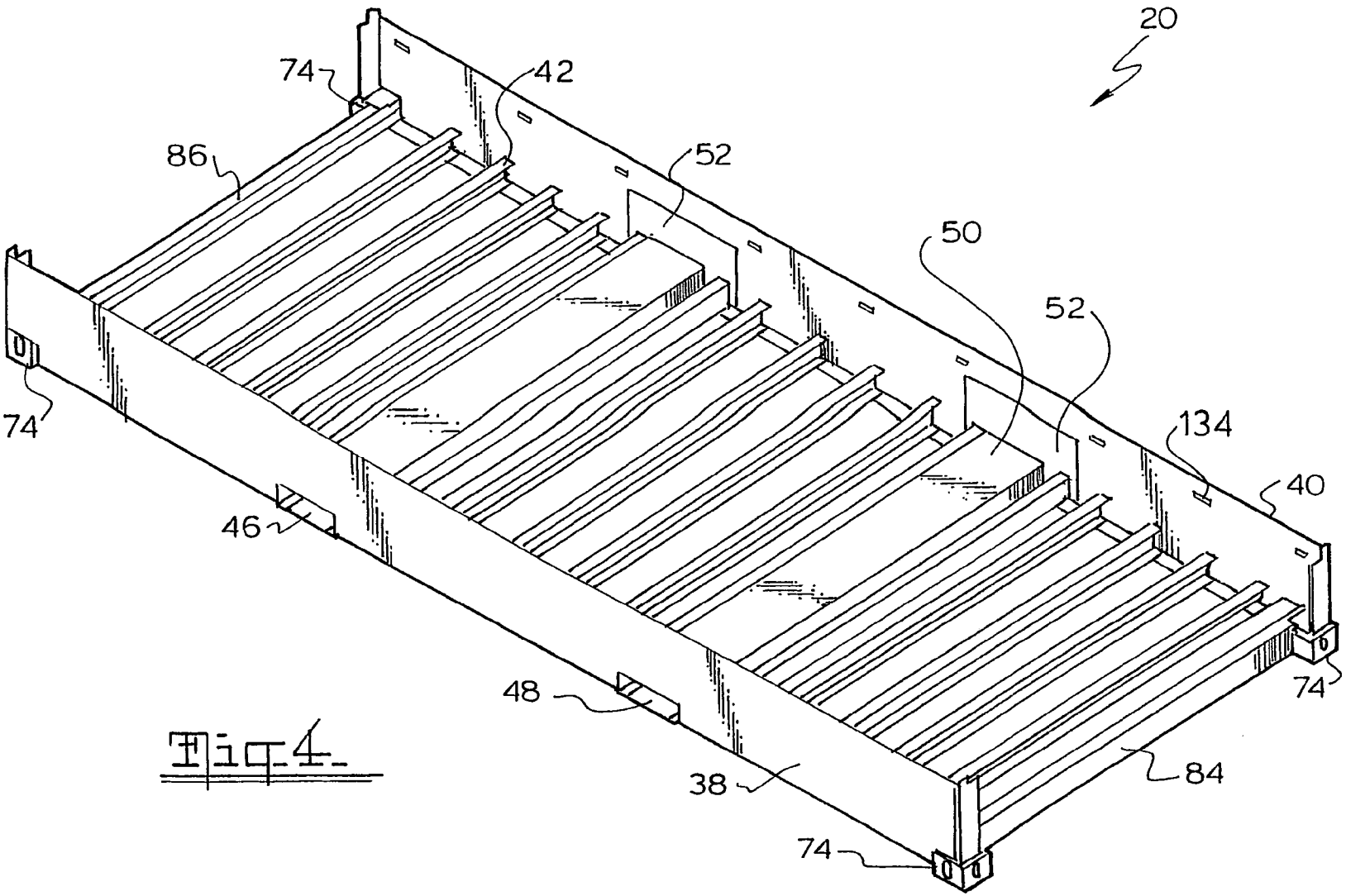
FIG. 4 is a perspective view of the base structure of the container shown in FIG. 1.

The base structure 20 has upturned base skirtings 38 and 40 at sides thereof, a number of spaced cross members 42 extending between the base skirtings 38 and 40. A floor 44 is supported on the cross members 42. The base structure 20 also has fork pockets 46 and 48 for insertion of the forks of a forklift truck. Each of the pockets 46 and 48 are formed of a tubular member 50. As can be seen in FIG. 3, the tubular members 50 are reinforced by stiffener plates 52 that are welded to the base skirtings 38 and 40. Base corner fittings 74 are fitted to respective ends of the cross members 70 and 72. The base structure 20 is shown more clearly in FIG. 4 in which the floor 44 is removed for clarity.

Figure 5:
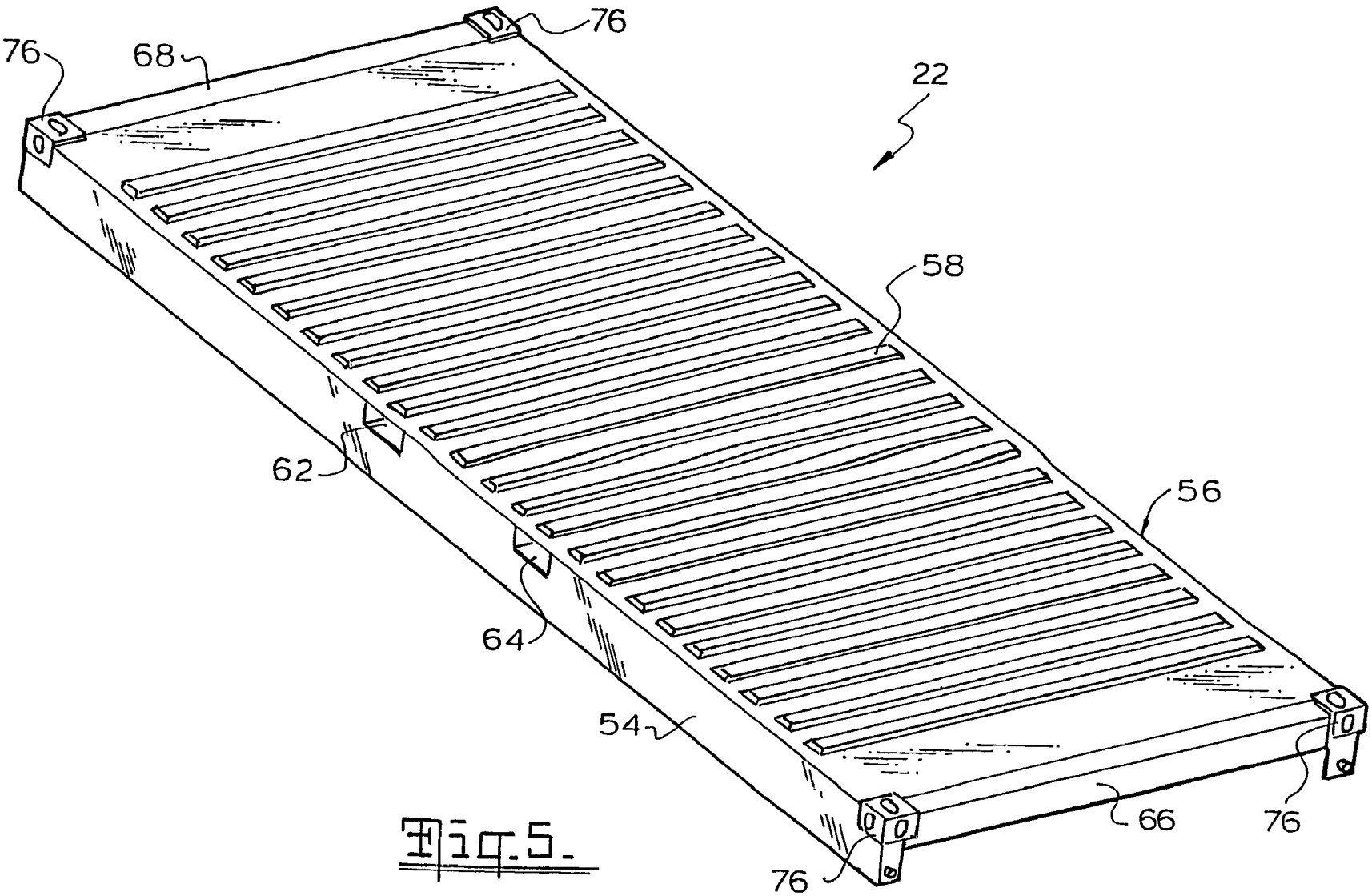
FIG. 5 is a perspective view of the top structure of the container shown in FIG. 1.

The top structure 22 has down turned top skirtings 54 and 56 (see FIG. 3) at sides thereof, and a number of spaced cross members 58 extending between the top skirtings 54 and 56. A roof 60 is supported on the cross members 58. As described with reference to FIG. 2, the top skirtings 54 and 56 are slightly bowed in the untensioned state. The top structure 22 also has fork pockets 62 and 64 for insertion of the forks of a forklift truck. The pockets 54 and 58 are formed of tubular members similar to the member 50 for the base structure 20. As can be seen in FIG. 3, the tubular members 50 are reinforced by stiffener plates 52 that are welded to the base skirtings 38 and 40. Top end skirtings 66 and 68 are arranged to extend between top corner fittings 76. The top structure 22 is shown more clearly in FIG. 5 in which the roof 60 has been removed for clarity.

Figure 6:
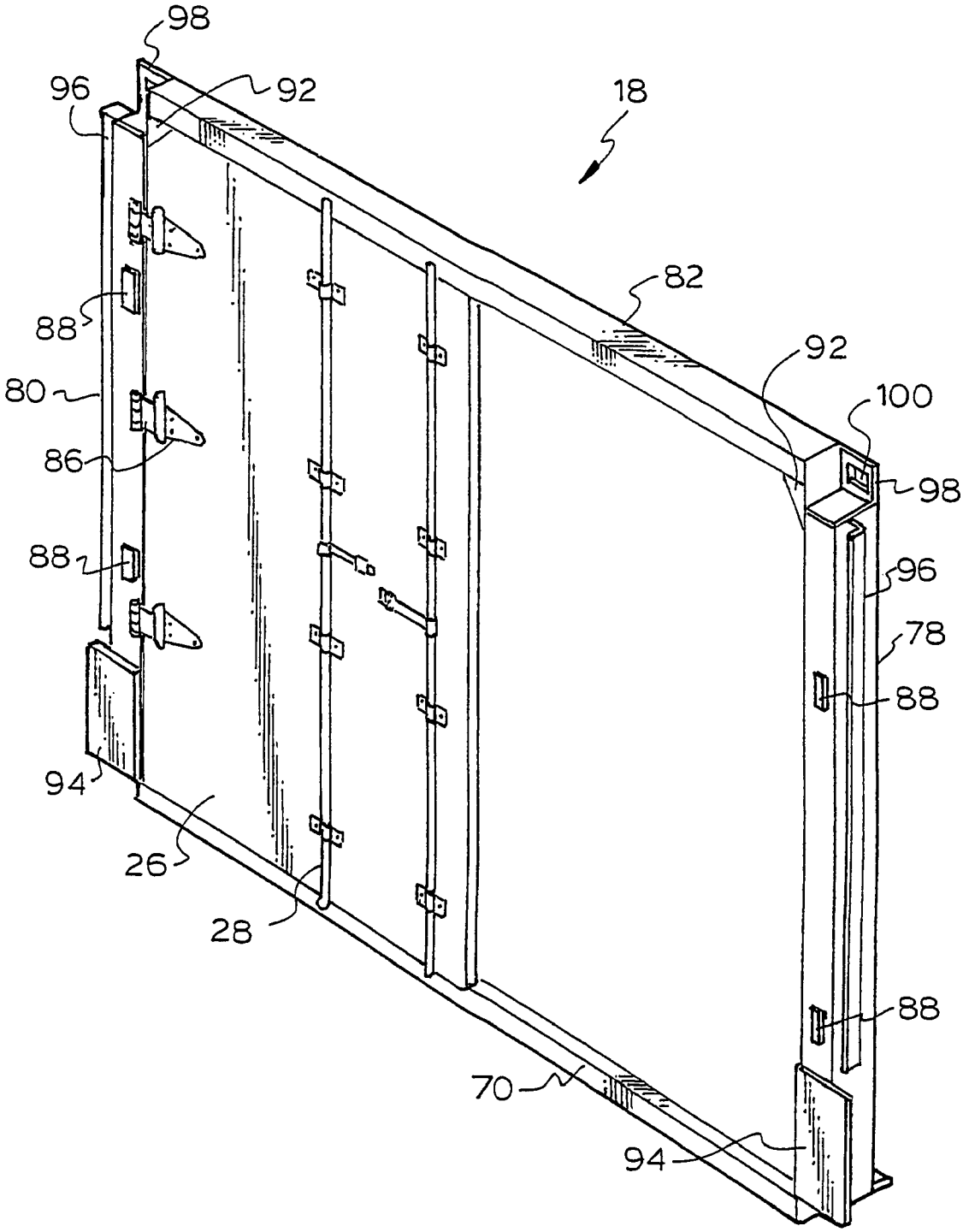
FIG. 6 is a perspective view of the end door cover of the container shown in FIG. 1.

The end cover 18 as shown in FIG. 6 has spaced posts 78 and 80, a top cross frame member 82, a bottom cross frame member 70 and two swinging doors 26 (one only shown) for selectively opening and closing access to the interior space 24. The doors 26 are connected to the respective posts 78 by hinges 86, and locking bars 28 are provided for locking the doors 26 in the closed position. The posts 78 and 80 have positioning lugs 88 arranged to fit in the positioning holes 90 in the upper section frame 30 and the lower section frame 32 of the side covers 12 and 14 when the end cover 18 is in the upright position as shown in FIG. 1. Gusset plates 92 are fixed to respective posts 78 and 80, and the cross frame member 82. Each of the posts 78 and 80 also has a load bearing plate 94 at their lower end and a flange 96 extending laterally therefrom and between the top end and bottom end. The top end of each of the posts 78 and 80 has an L-shaped plate 98 with a positioning hole 100.

Figure 7:
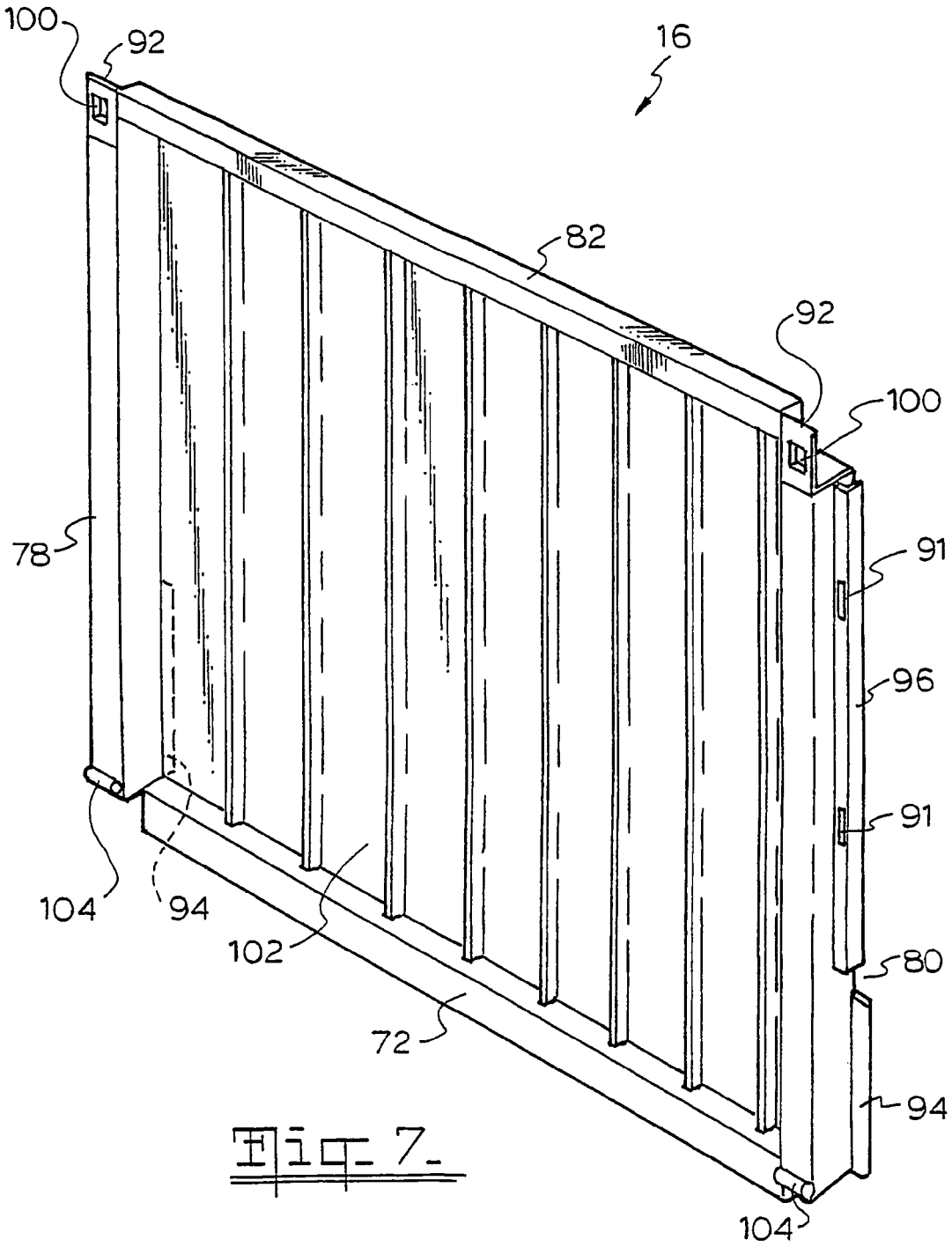
FIG. 7 is a perspective view of the end cover of the container shown in FIG. 1.

The end cover 16 shown in FIG. 7 is substantially similar to the end cover 18 except that it has a corrugated steel panel 102 covering its opening. As can be seen here, the positioning holes 91 are provided in the flange 96 of each of the posts.

Figure 9:
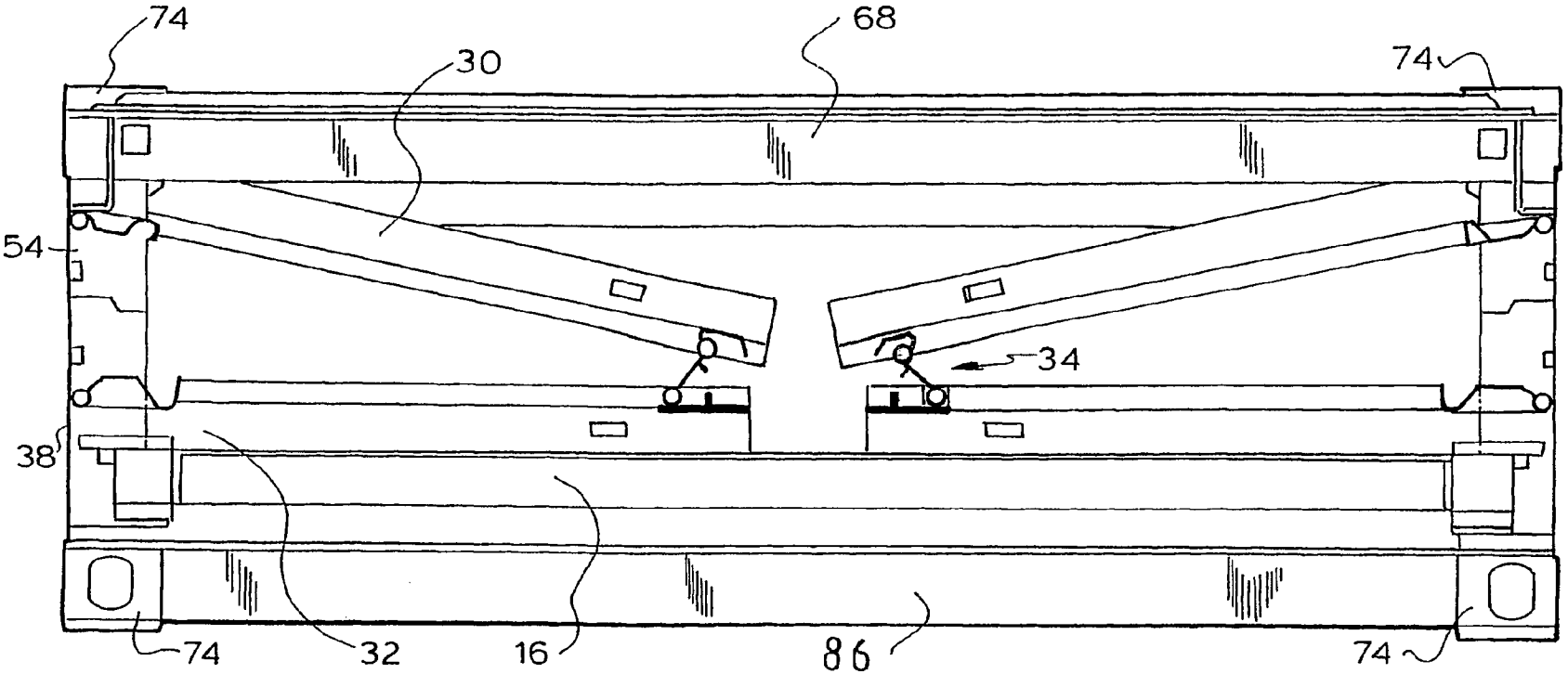
FIG. 9 shows the container of FIG. 1 in its fully collapsed state.
Figure 10:
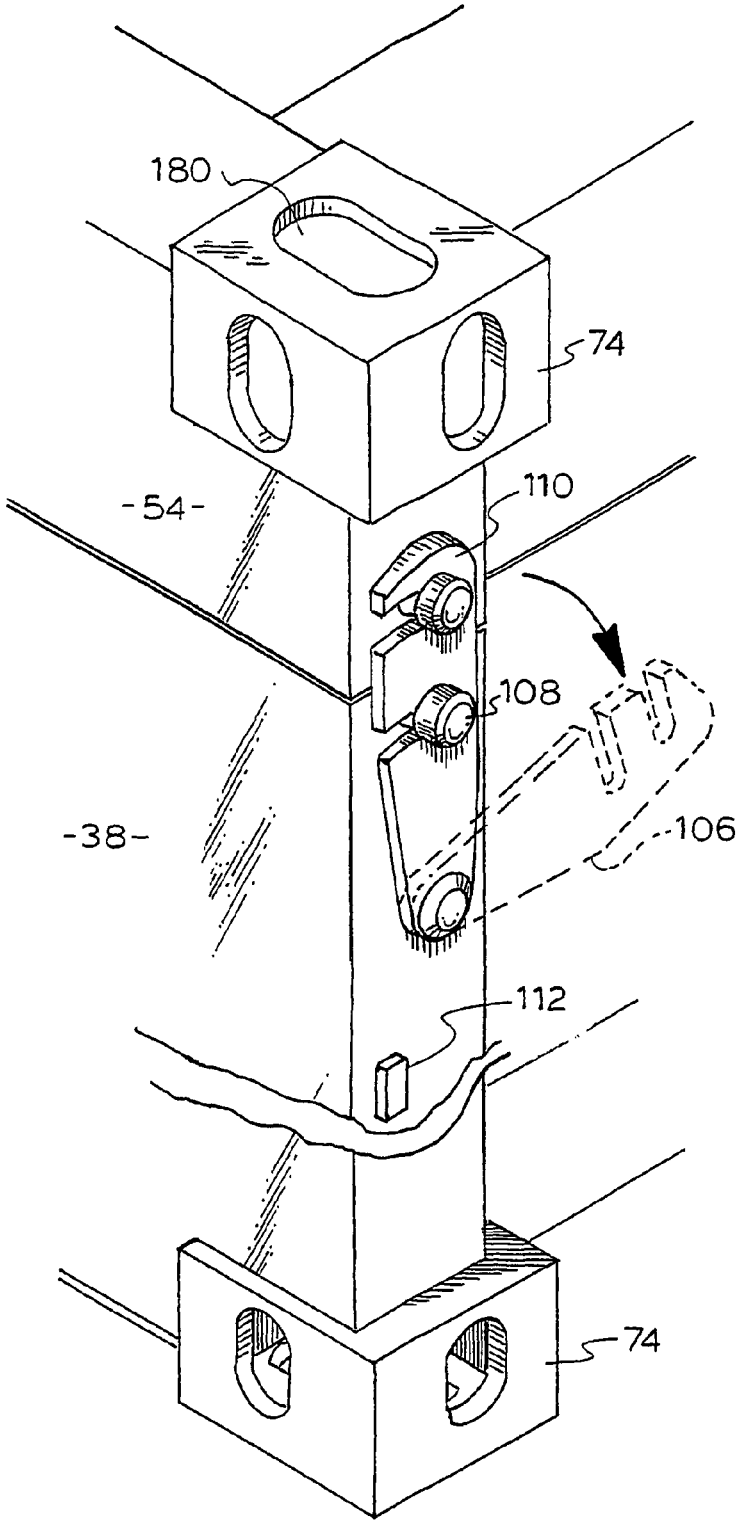
FIG. 10 shows a locking arrangement for locking the container shown FIG. 9 in the fully collapsed state.

The end covers 16 and 18 have pivot pins 104 pivotally connected to the end frame members 84 and 86 of the base structure 20. As can be seen in FIG. 8, these end covers can be pivotally move to a lowered position at which they rest on the floor 44. The side covers 12 and 14 can then be folded about the central hinge arrangement 34 until the container 10 is in a fully collapsed state as shown in FIG. 9. In the collapsed state, the top skirtings 54 and the base skirtings 38 meet at their edges. The base skirtings 38 have a pivotal locking lug 106 at each end as shown in FIG. 10. The lugs 106 are movable to each receive a locking pin 108 on the base skirting 38 and a locking pin 110 on the top skirting 54. A stop member 112 is provided for the each lug 106 to rest thereat when the container 10 is to be moved to the erected position.

Figure 11:
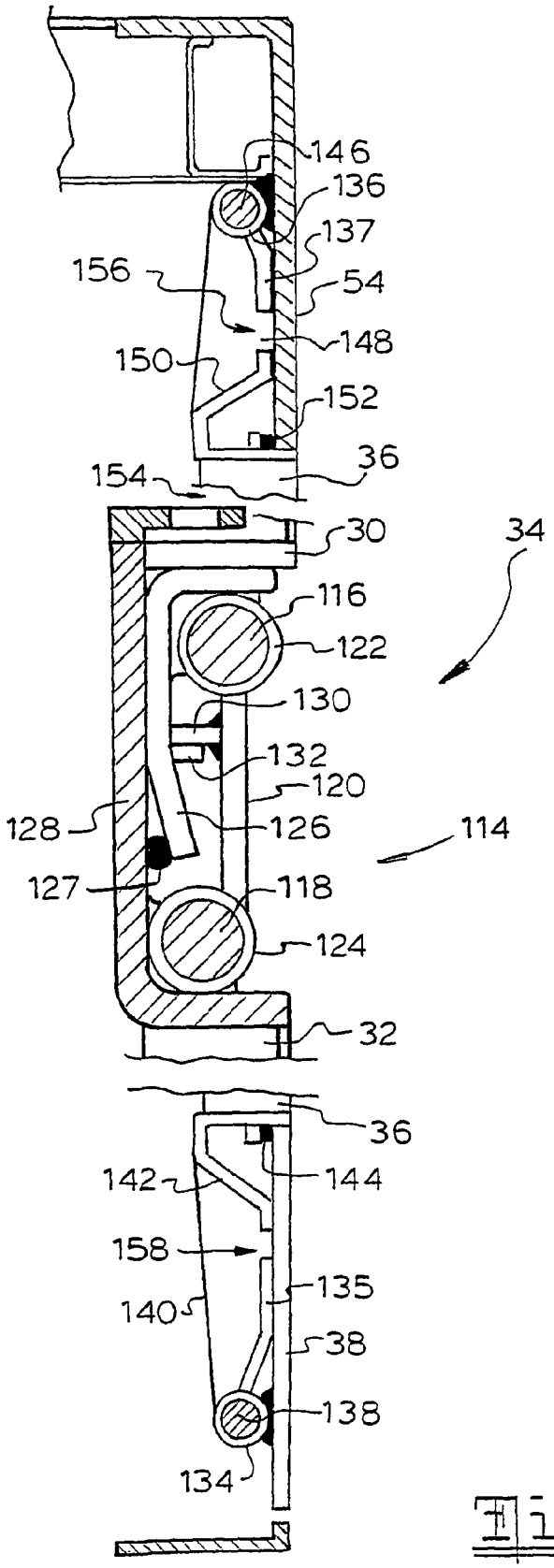
FIG. 11 is a cross-section view of the load distribution arrangement for the side covers of the container of FIG. 1.

The central hinge arrangement 34 has a number of spaced double hinge 114. FIG. 11 shows a cross-section of the arrangement 34 at one of the double hinge 114. As shown the double hinge 114 has spaced pivot pins 116 and 118 fixed to ends of a bridging plate 120, The pins 116 and 118 are received in respective sleeves 122 and 124. The sleeve 122 is fixed a load bar 126 and the sleeve 124 is fixed to a central load distribution plate 128. The bridging plate 120 has a clamping plate 130 arranged to engage a lug 132 extending from the load bar 126 when the side section frames 30 and 32 are in alignment. The distribution plate 128 has one end fixed to the lower section frame 32 and an upper end in engagement with the upper section frame 30 when in the position shown. In this embodiment, the plates 128 extend to full length of the side covers so that the side covers become fully covered solid walls when the container is in the erected state. A cam may be arranged to lock the plate 128 in position. The plate 128 and the plate 126 of each of the hinges 114 are arranged to distribute load between the upper section frame 30 and the lower section frame 32.

Figure 15:
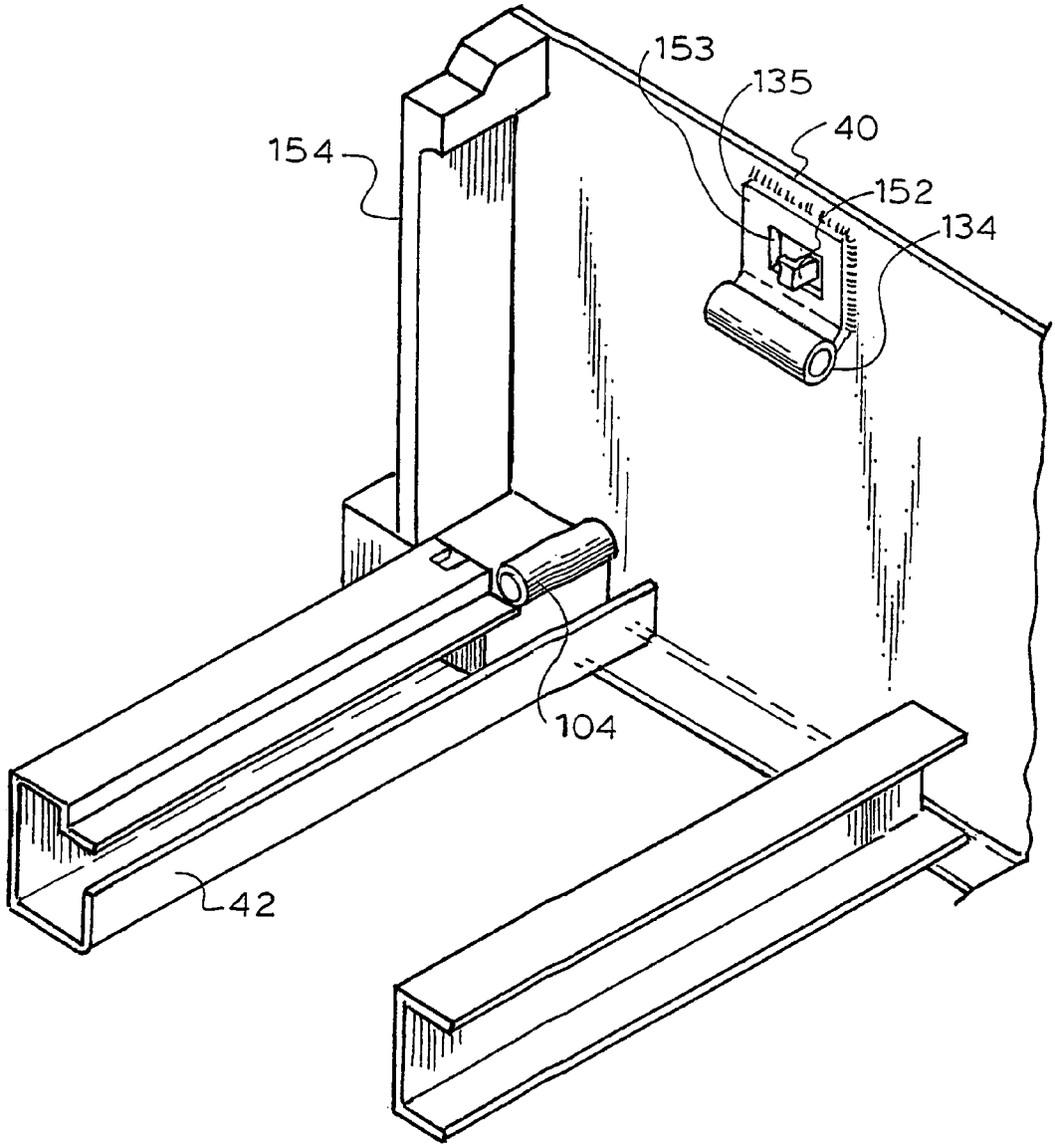
FIG. 15 is a partial view of the base structure of the container shown in FIG. 4.

The base skirtings 38 has a number of spaced sleeves 134 in vertical alignment with the double hinges 114. The top skirtings 54 also has a number of spaced sleeves 136 in alignment with the hinges 114. Each of the sleeves 134 are fixed by a hinge plate 135 to the respective skirting 38 and arranged to receive a pivot pin 138 carried on a lower gusset plat 140 that is fixed to a cover panel 36 or to the lower frame section 32. A sealing backing plate 142 is arranged to locate a sealing strip 144 in position. The plate 142 has one end connected to the top edge of the skirting 38 and another end engaging the inside surface of the skirting 38. As shown in FIG. 15, the hinge plate 135 has an opening 153 arranged to receive a load bar 152 extending from the skirting 38. Thus, load on the pin 138 is substantially reduced.

Each of the sleeves 136 at the top skirtings 54 are fixed by a hinge plate 137 to the respective skirting 54 and arranged to receive a pivot pin 146 carried on a top gusset plat 148 that is fixed to the lower frame section 32. A seal backing plate 150 is arranged to locate a sealing strip 152 in position. The sealing backing plate 150 and the hinge plate 137 are arranged similar to that for the base skirting 38 to transfer load from the pin 146.

Figure 12:
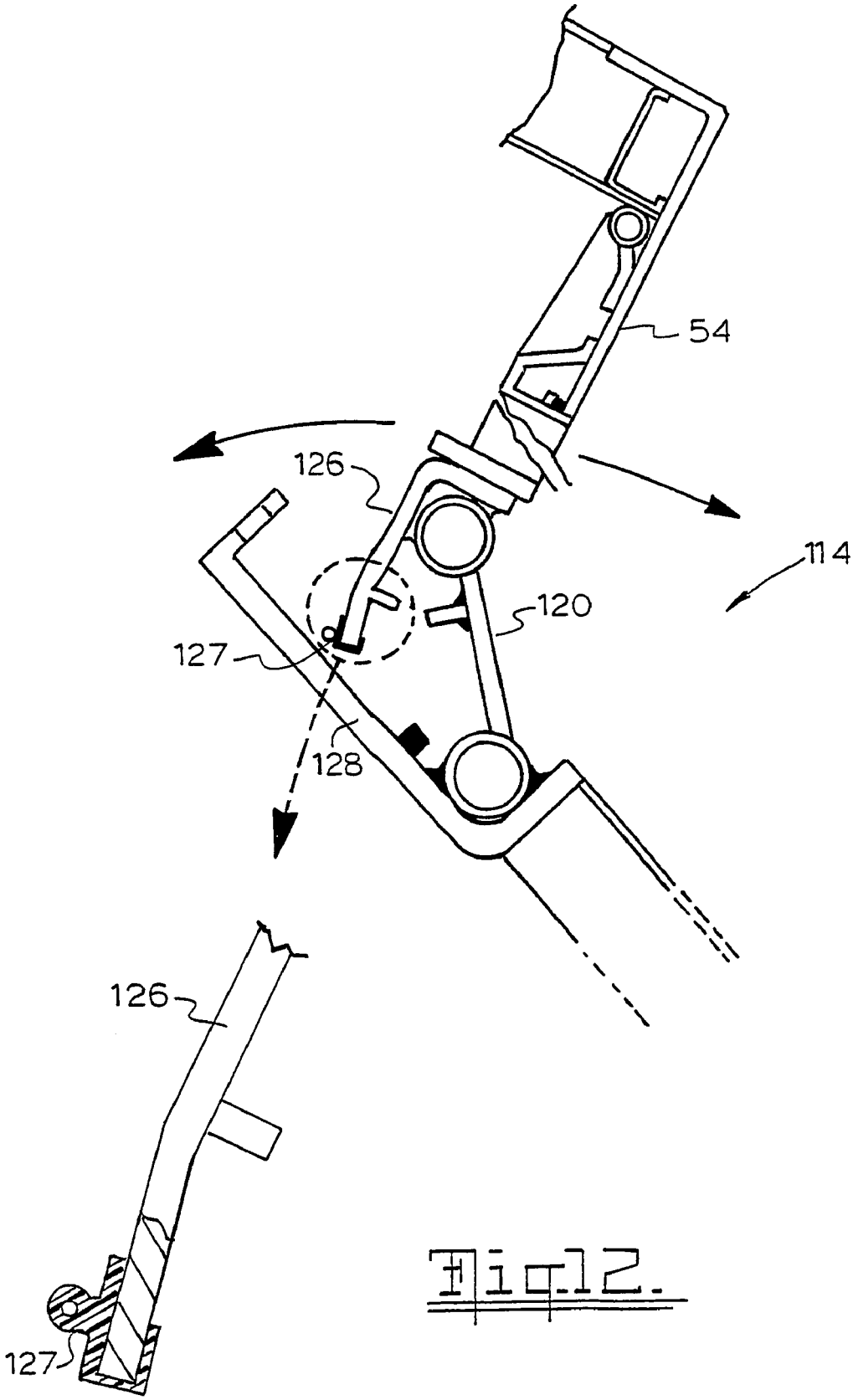
FIG. 12 shows the middle hinge of the side cover in a partly collapsed position.

The arrow heads 154, 156 and 158 show positions where cam members (not shown) can be arranged to apply tension and improve strength of the side covers and the skirtings. FIG. 12 shows the central hinges 114 in an open position. A clip on seal 127 is fixed to the free end of the load bearing plate 126. The seal 127 prevents water from entering the container 10 when the container is in the erected state.

The central hinges 114, the top hinges formed of pins 146 and sleeves 136, and the lower hinges formed of sleeves 134 and pins 138 cooperate to distribute load on the side overs 12 and 14 evenly between the top skirtings 54 and the base skirtings 38.

Figure 13:
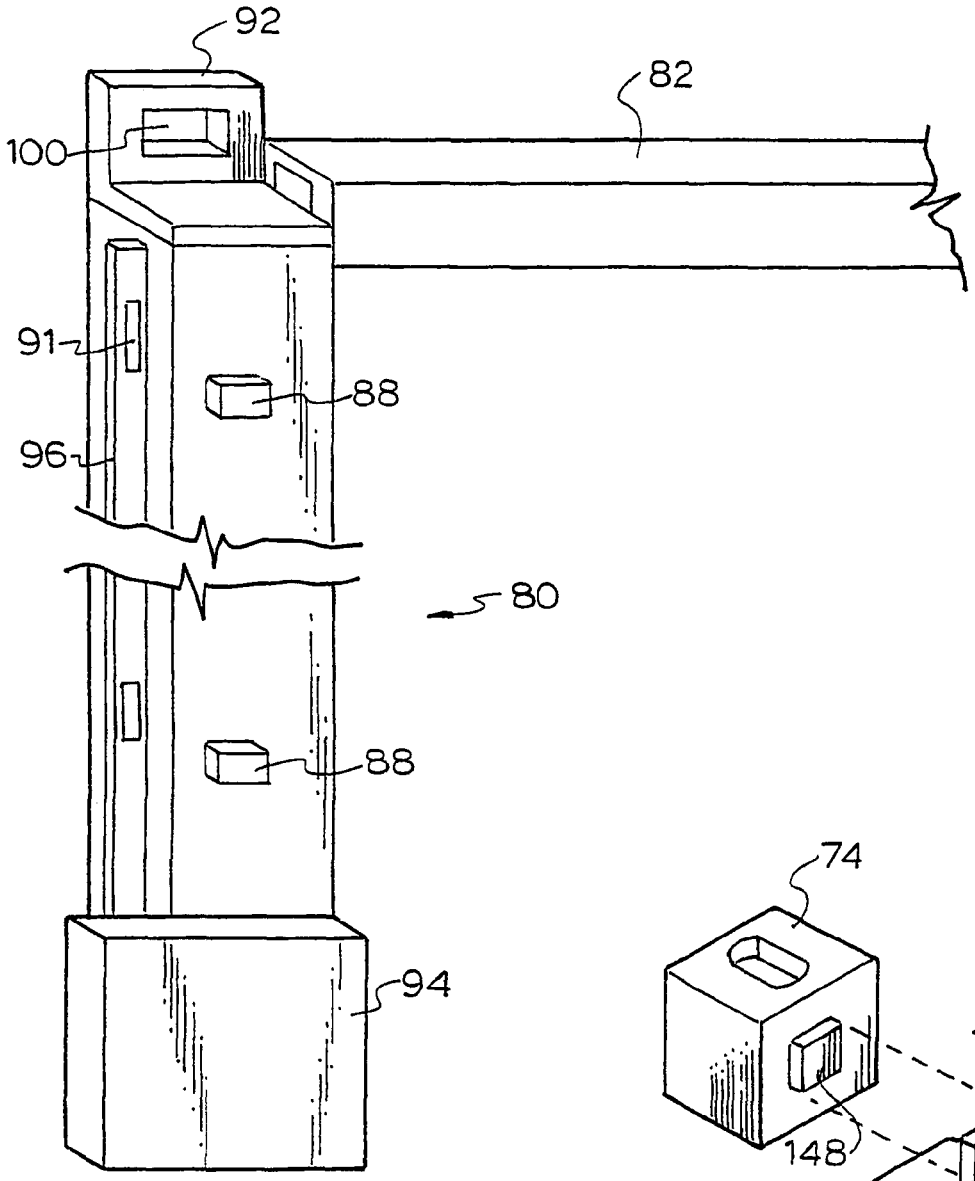
FIG. 13 is a partial perspective view of a frame for the end door cover.
Figure 17:
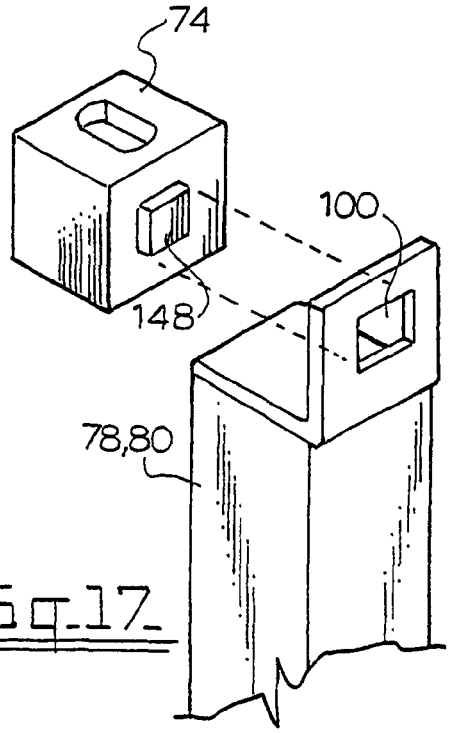
FIG. 17 is a partial view of a positioning arrangement at the upper end of a post of the door frame shown in FIG. 13.

FIG. 13 shows the post 80 in detail. As shown in FIG. 17, the positioning hole 100 on top of a post 78 or 80 is configured to receive a lug 148 on a face of a corner fitting 74.

Figure 14:
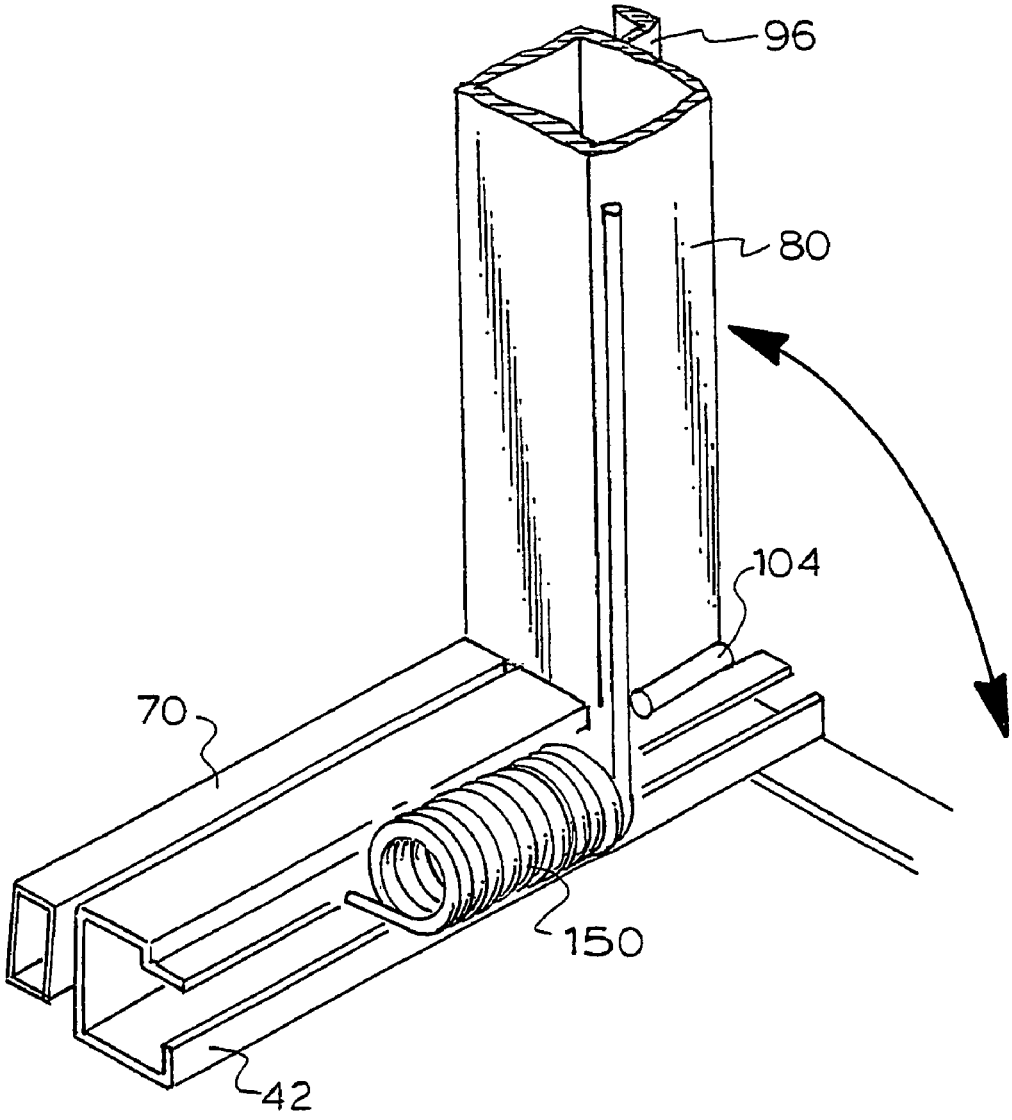
FIG. 14 is a partial perspective view of a lower end of the frame for the end door cover.

FIG. 14 shows a lower corner at one end of the container 10. Positioned at this corner is a post 80 with the end frame member 70 extending therefrom. A base cross member 42 is configured to receive a spring 150 for biassing an end cover 16 or 18 to the upright position. The spring 150 is arranged to have one end in the section 160 shown in FIG. 18.

FIG. 15 shows the base skirting 40 having spaced load bars 153 (one only shown) arranged therealong and an end stiffener plate 154 at an end thereof. While not shown, it should be understood that each end of the base skirtings 38 and 40 has a stiffener plate 154 arranged thereat.

Figure 16:
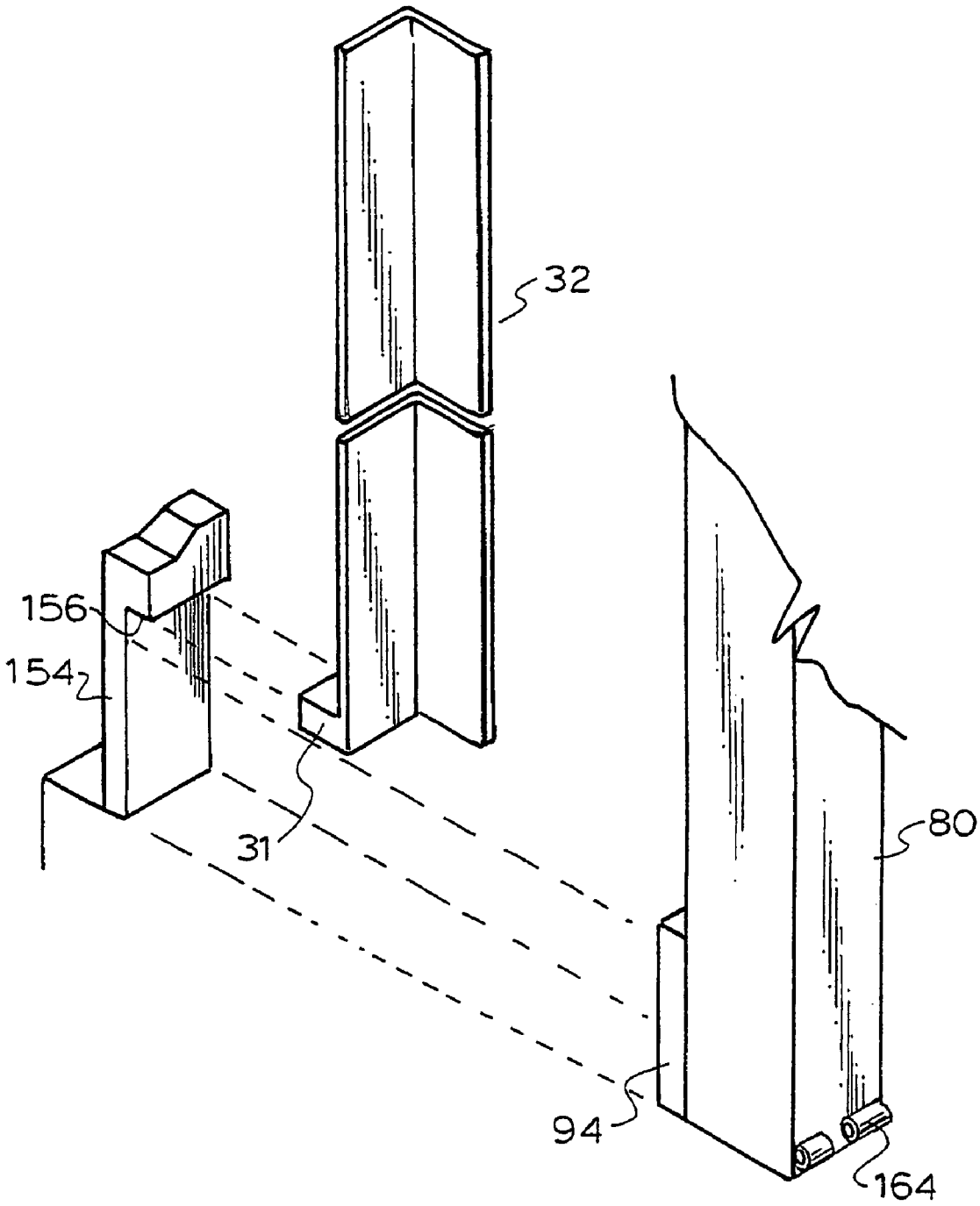
FIG. 16 is a partial view of a load bearing arrangement at the lower end of a post of the door frame shown in FIG. 13.

As shown in FIG. 16, the stiffener plate 154 has an upper load bearing surface 156 arranged to receive a flange 31 of the lower section frame 32. The flange 31 in turn engages the load bearing plate 94 of a corresponding post 78, 80 when the end cover 16, 18 is in the upright position.

Figure 19:
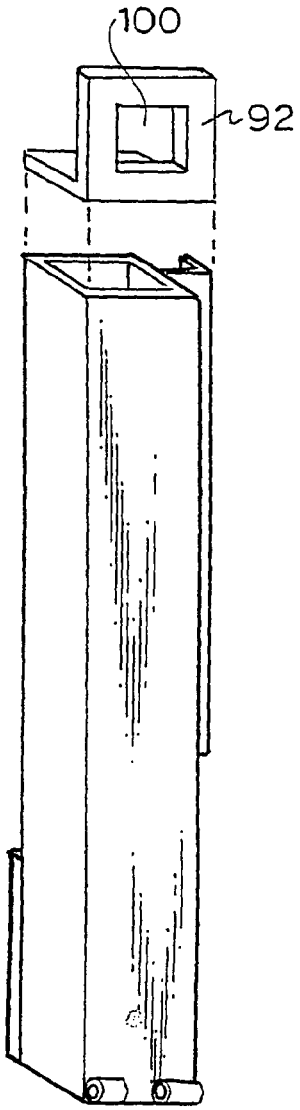
FIG. 19 shows the parts shown in FIG. 18 about to be completely assembled.
Figure 18:
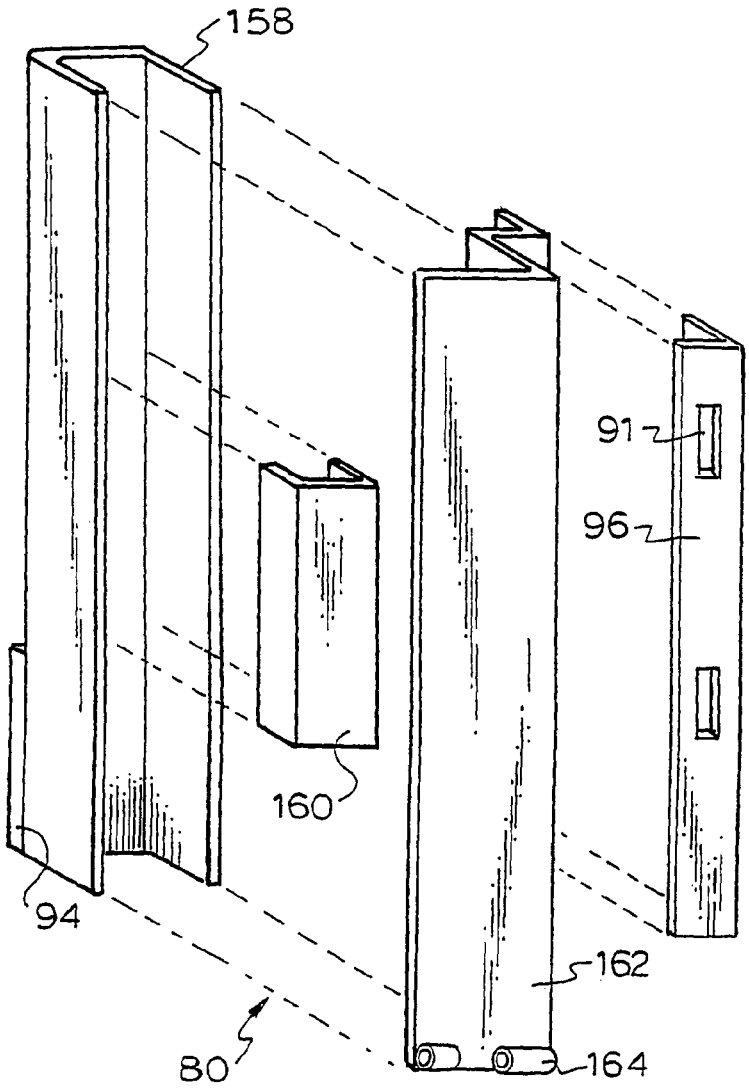
FIG. 18 shows parts to be assembled to form a post of the door frame shown in FIG. 13.

FIG. 18 shows that each of the post 78 and 80 is formed of elongate shaped members including a U-shaped channel member 158, a short stiffener channel section 160 fixed to the inside of the member 158, and a zigzag shaped section 162 arranged to close the channel member 158. The load bearing plate 94 is fixed to the lower end of the U-shaped channel member 158. The section 160 is arranged to receive an end of the spring 150. The section 162 has the flange 96 that extends laterally, and sleeves 164 at its lower end arranged to receive the sleeve 104 therebetween. A pin (not shown) then extends through the aligned sleeves 164 and 104. Whereby an end cover is pivotally supported. A L-shaped section 92 is then fixed to the top end of the post assembly as shown in FIG. 19.

Figure 20:
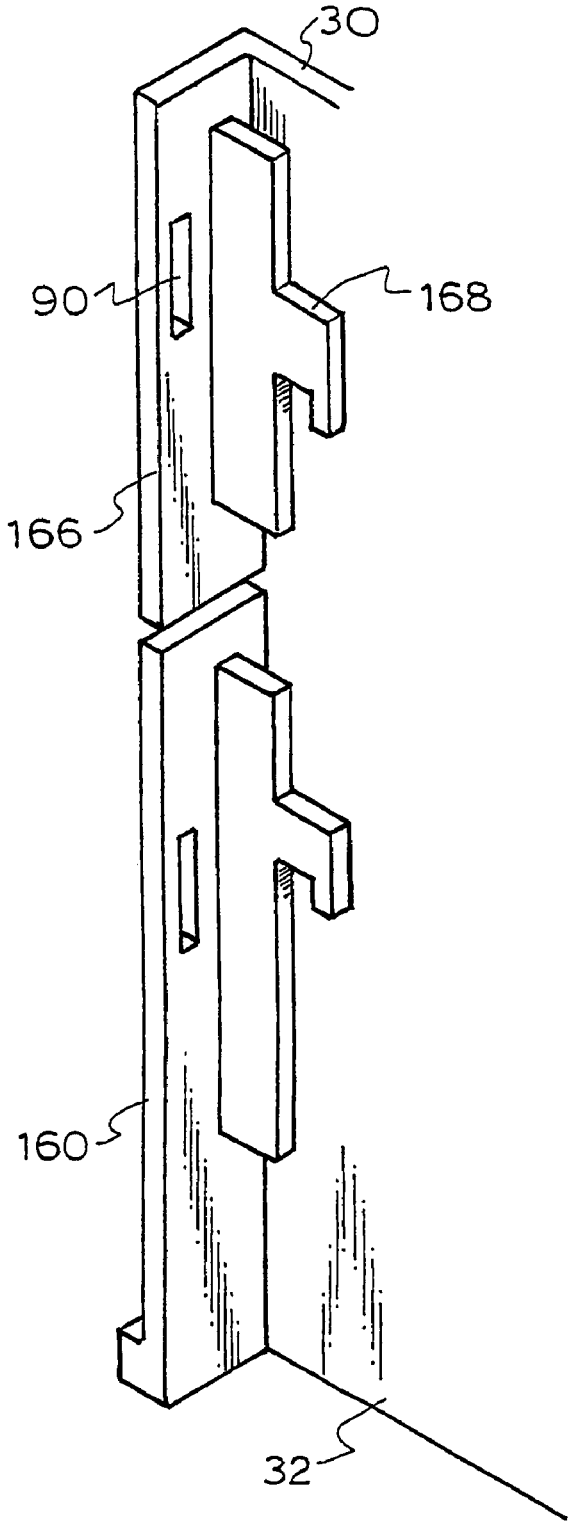
FIG. 20 is a partial view showing hook shaped guide plates on a side cover.
Figure 20A:
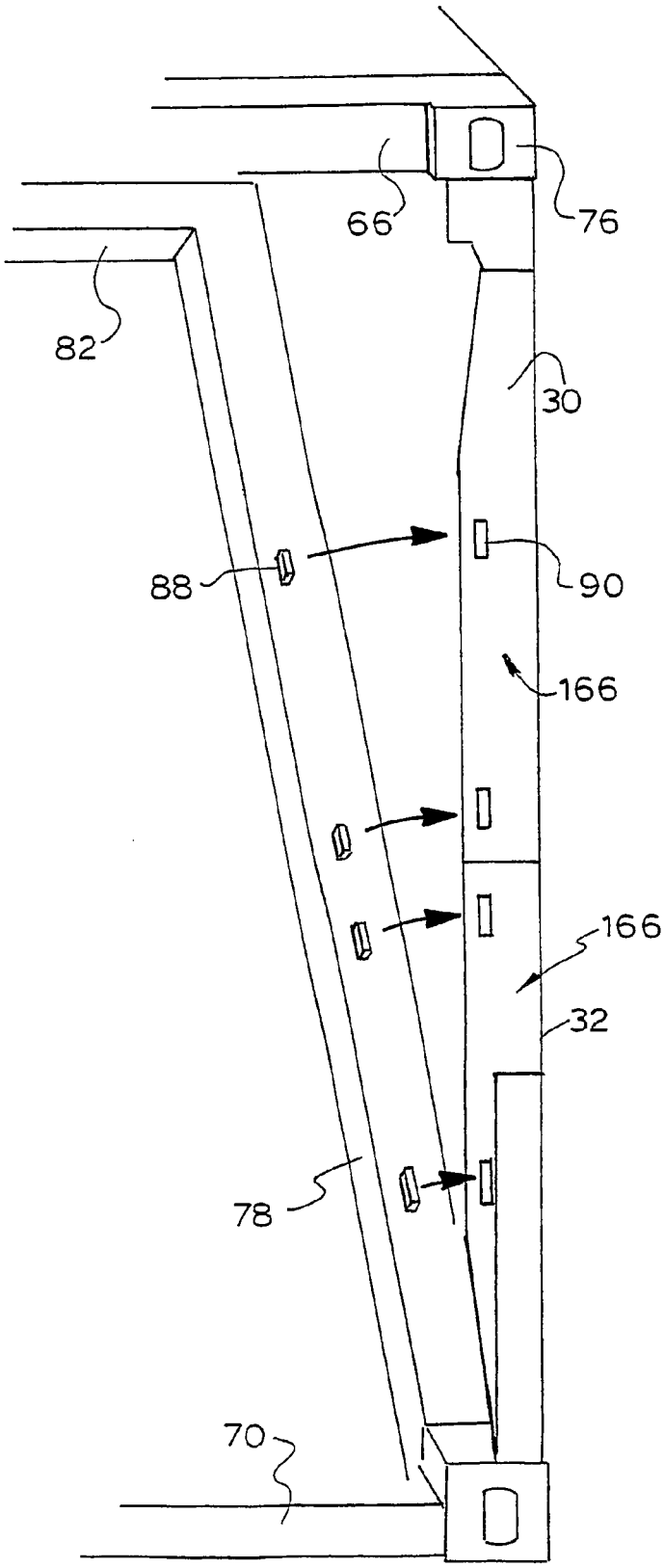
FIG. 20A shows an end cover being positioned into its upright position for fixing to the upper and lower section frames of the side covers.
Figure 21:
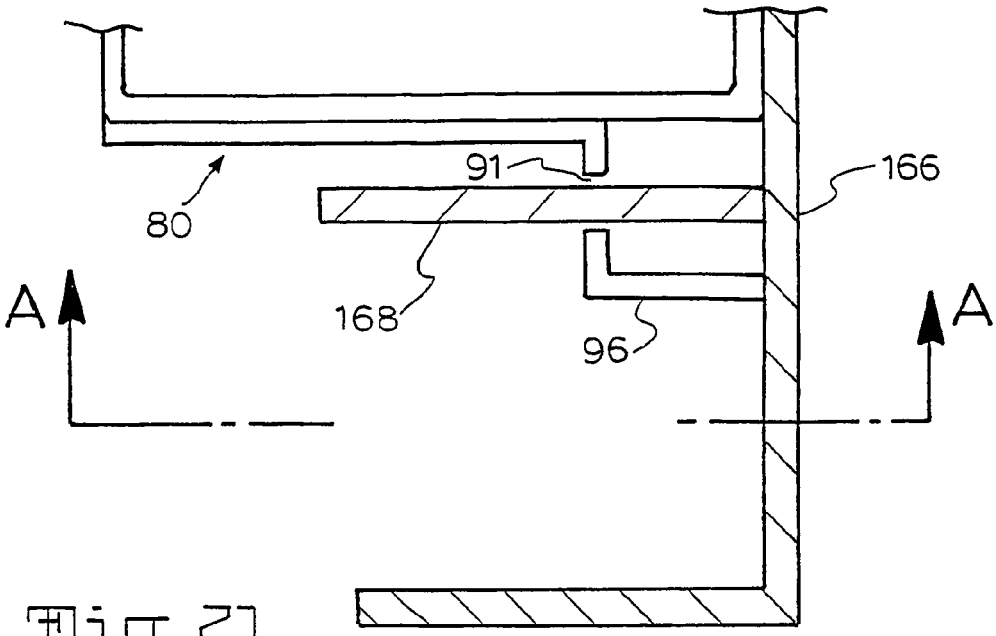
FIG. 21 is a partial schematic view one the hook shaped guide plates shown in FIG. 19 in a guide aperture on a post of the door frame.
Figure 22:
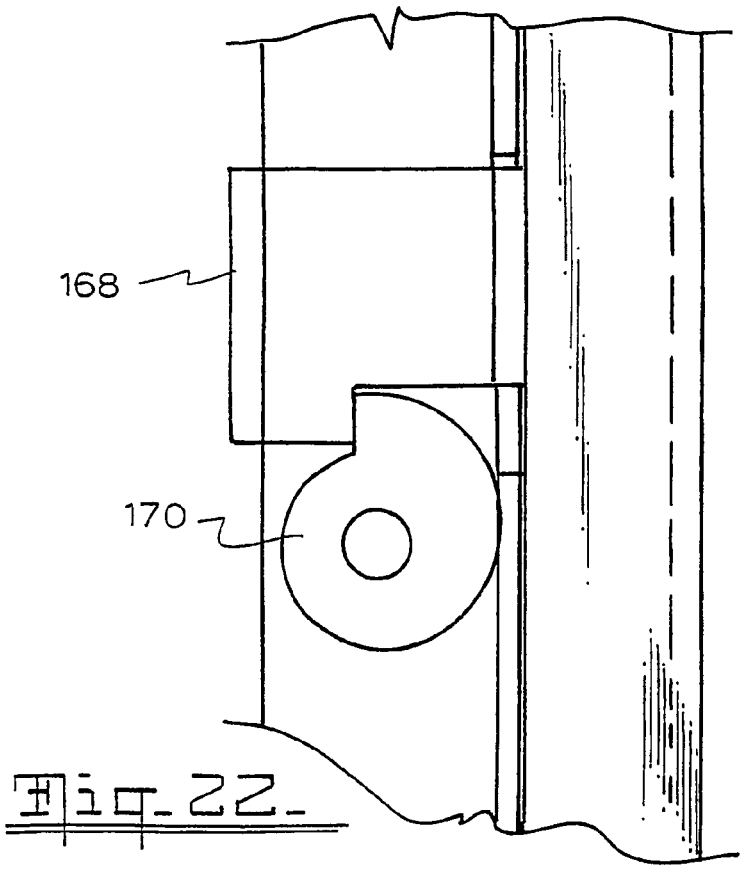
FIG. 22 a cross-section view along A-A of the guide plate shown in FIG. 20.

FIG. 20 shows a partial view of a bent end 166 of each of the section frames 30 and 32 of one of the side covers 12 and 14. Each of the bent ends 160 have the positioning hole 90 described beforehand, and a hook shaped locating plate 168. The hook shaped plates 168 are configured to extend into the holes 91 of the posts 78 and 80 when in the upright position. As shown in FIG. 20A, the positioning lugs 88 on the posts 78 and 80 of each of the end covers 16 and 18 would also be received in the corresponding positioning holes 90 in the bent ends 166 of the section frames 30 and 32 of the side covers 12 and 14, when the end covers are in the upright position. FIG. 21 shows a locating plate 168 in a hole 91 and as shown in FIG. 22 which is a cross-sectional view at A-A, a cam 170 is provided on the post 78/80 for locking the plate 168 in position. The cam 170 is adjustably turnable to vary tension on a corresponding side cover 12/14. Whereby, the posts 78 and 80 when placed in the upright position and locked to the corresponding side covers 12 and 14, would tension the side covers along a longitudinal direction traversing the respective covers 12 and 14. The load bearing plates 94 and the holes 100 with the lugs 148 therein, also cause the side covers 12 and 14 to be in tension in a direction extending vertically.

Figure 23:
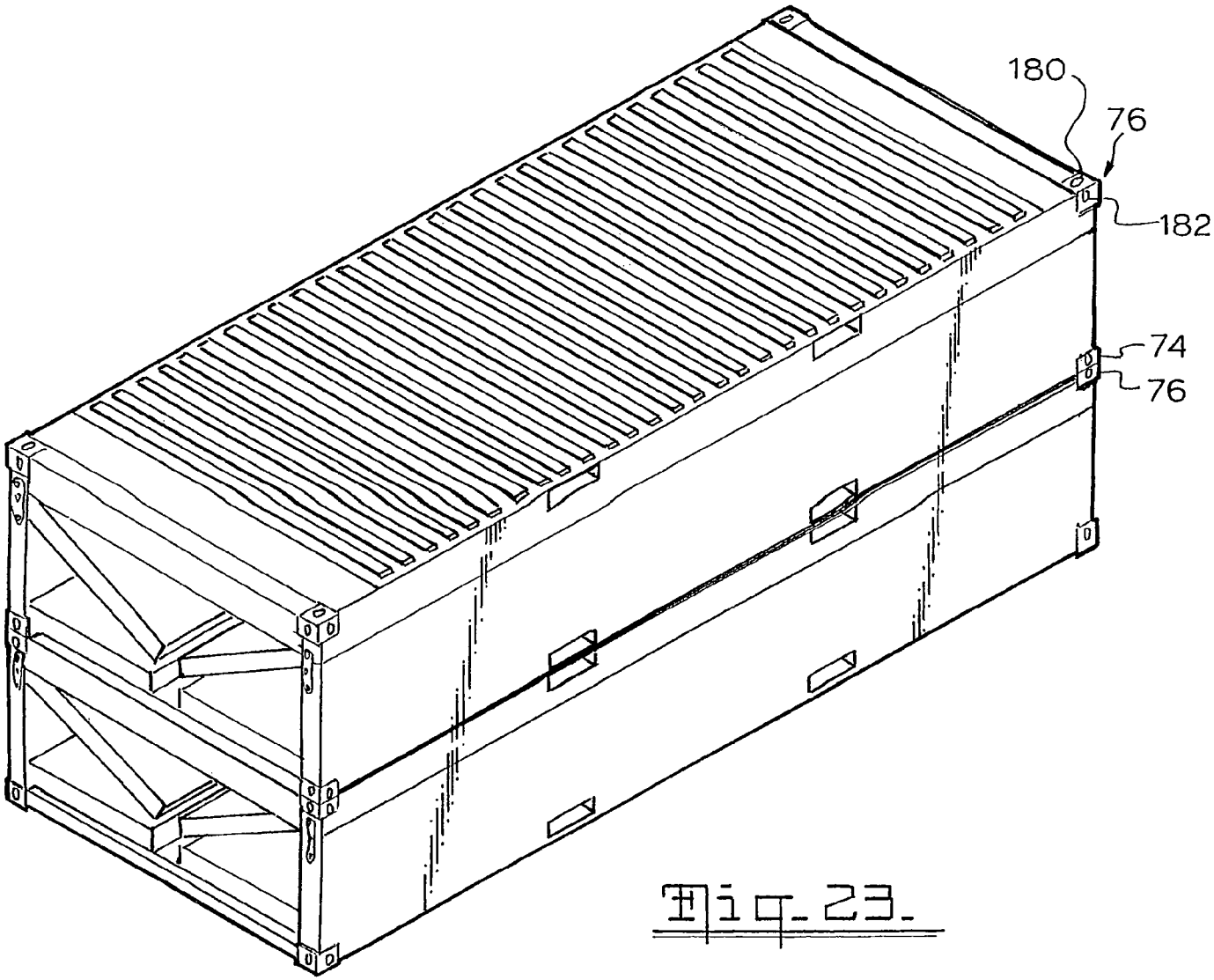
FIG. 23 is a perspective view showing two stacked containers according to the present invention.

As shown in FIG. 23, the container 10 can be stacked onto another container 10. Adjacent upper corner fittings 76 and lower corner fittings 74 are arranged to be locked. In this regard, each of the corner fittings 74 and 76 have a hole 180 arranged to receive a locking pin (not shown) that extends through the adjacent fittings 76 and 74. The pin is shaped to be turnable by positioning a portion thereof accessible through a side hole 182 to lock and unlock the adjacent corner fittings 74 and 76 in position.

Figure 24:
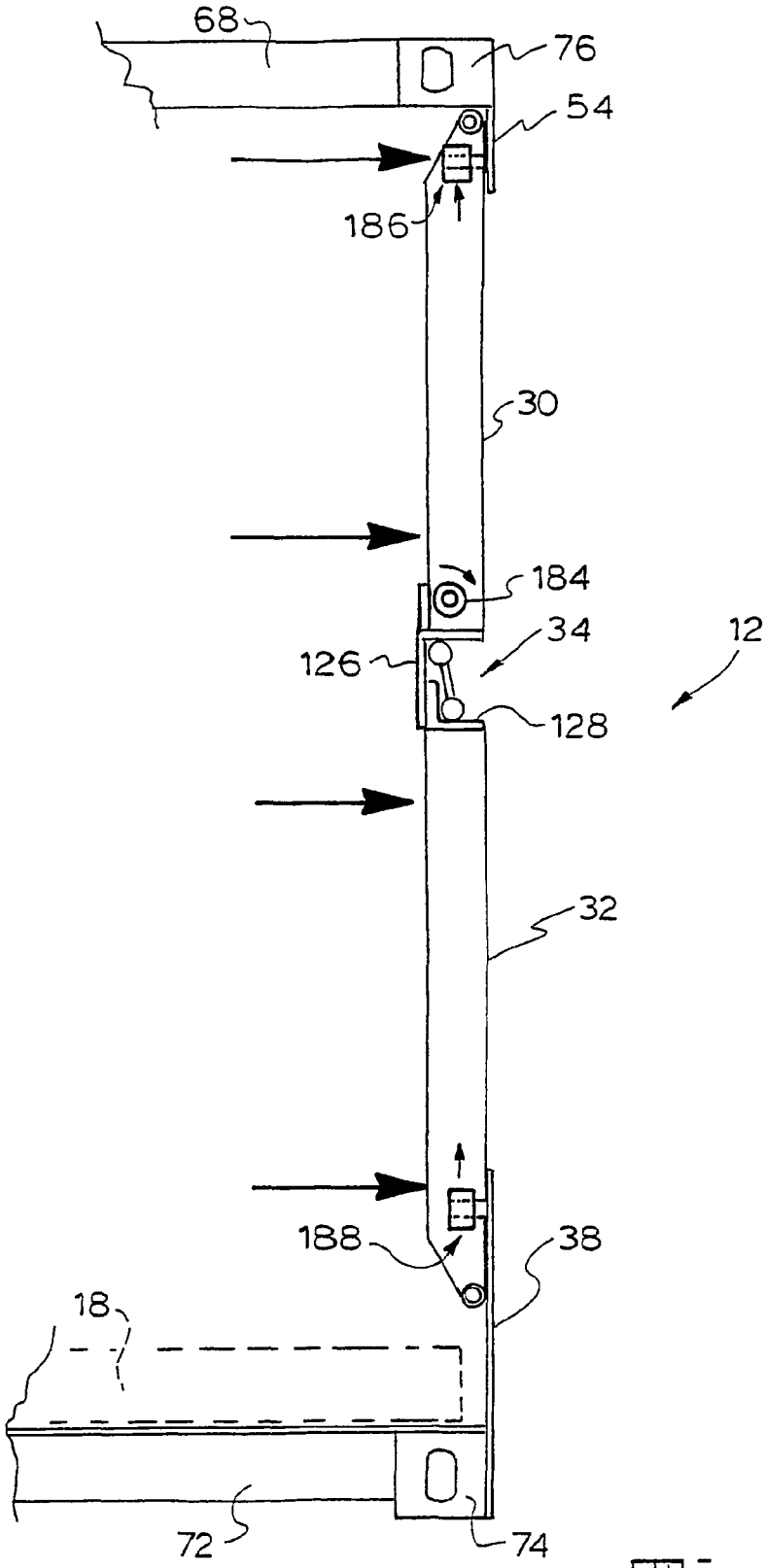
FIG. 24 is a partial end section view of another embodiment of the container according to the present invention, with the side cover in the fully erected position.

FIG. 24 shows a partial cross-section view of another embodiment of the container 10 according to the present invention. In this Figure, the side covers 12 and 14 (one only shown) have a central hinge arrangement 34 connected to the upper section frames 30 and the lower section frame 32. The upper section frame 30 is pivotally joined to the top skirting 54, and the lower section frame 32 is pivotally joined to the base skirting 38. Thus the side covers 12 and 14 can be moved between a collapsed position in which the lower section frames 32 overlie the end covers 18 and 20 similar to that shown in FIG. 9, and an erected position as shown in this Figure. A tensioning arrangement is provided to tension the side covers 12 and 14. The tensioning arrangement includes sets of paired tensioning elements spacedly provided along the side covers 12 and 14. Each set includes a pair of central tensioning elements 184, a pair of upper tensioning elements 186 and a pair of lower tensioning elements 188.

Figure 25:
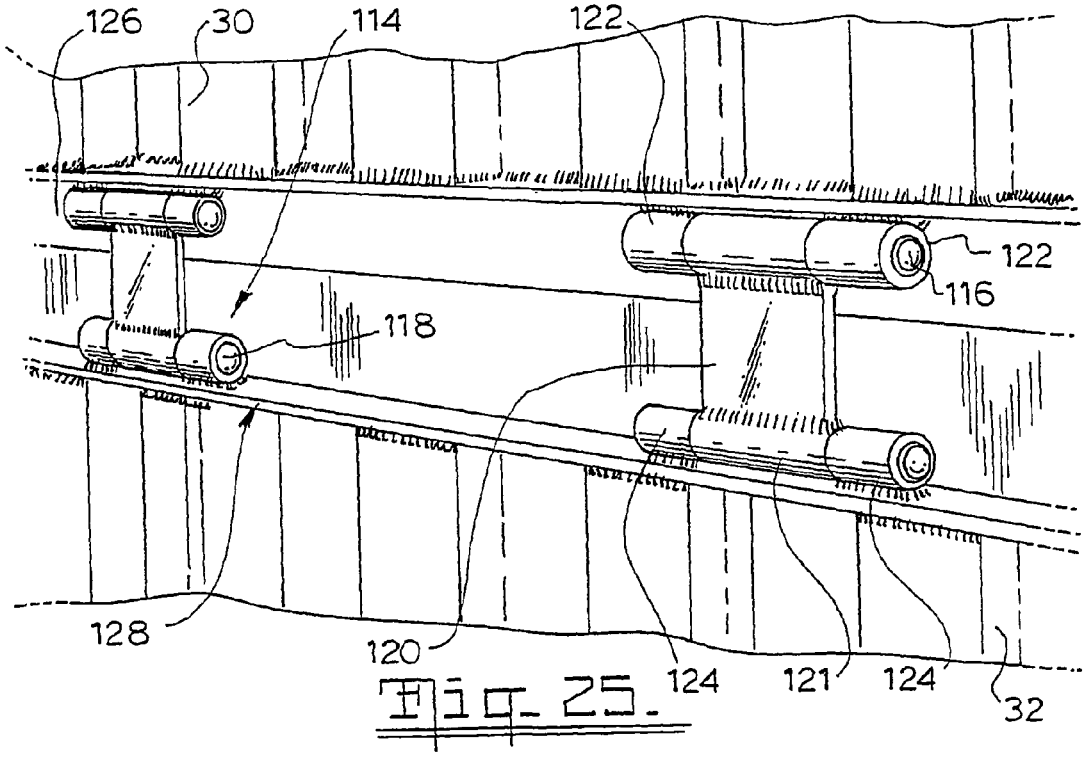
FIG. 25 is a partial perspective view of side cover of the container shown in FIG. 24.
Figure 26:
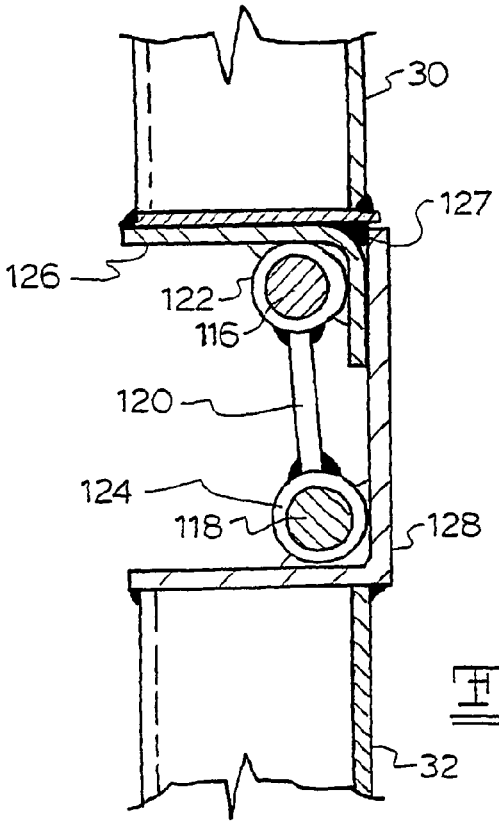
FIG. 26 is a partial section view of the central hinge arrangement on the side cover of the container shown in FIG. 25.
Figure 27:
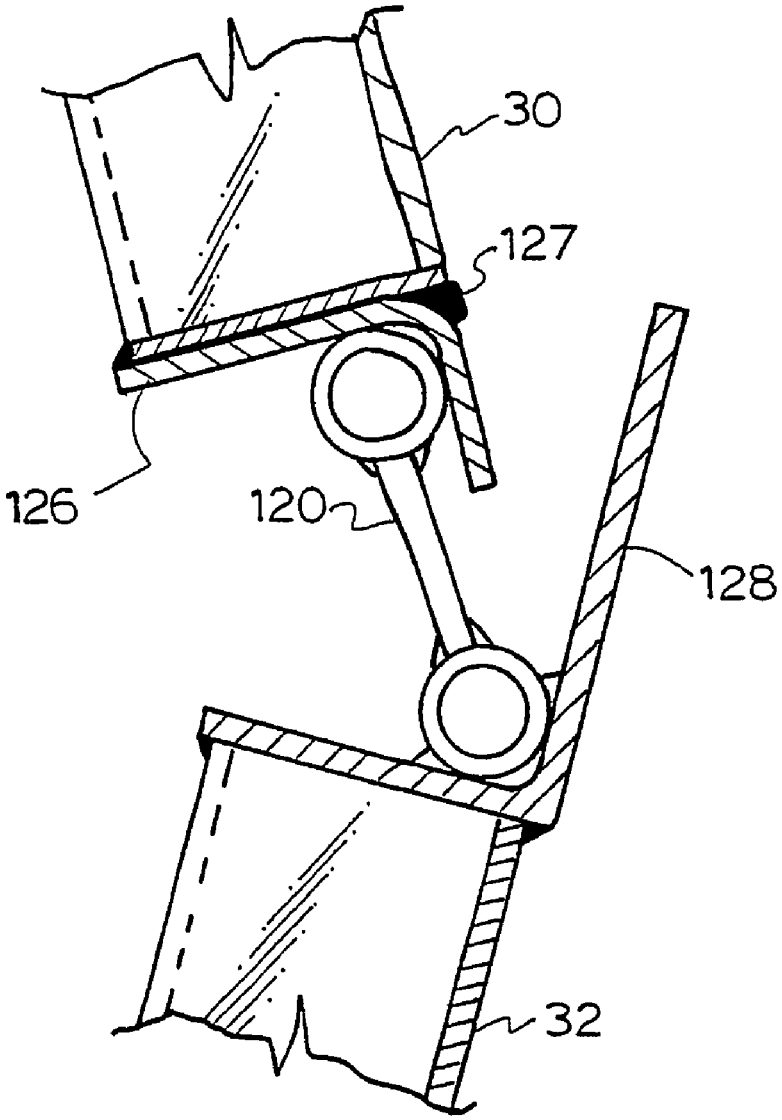
FIG. 27 shows the side cover shown in FIG. 26 in a partially collapsed position.
Figure 29:
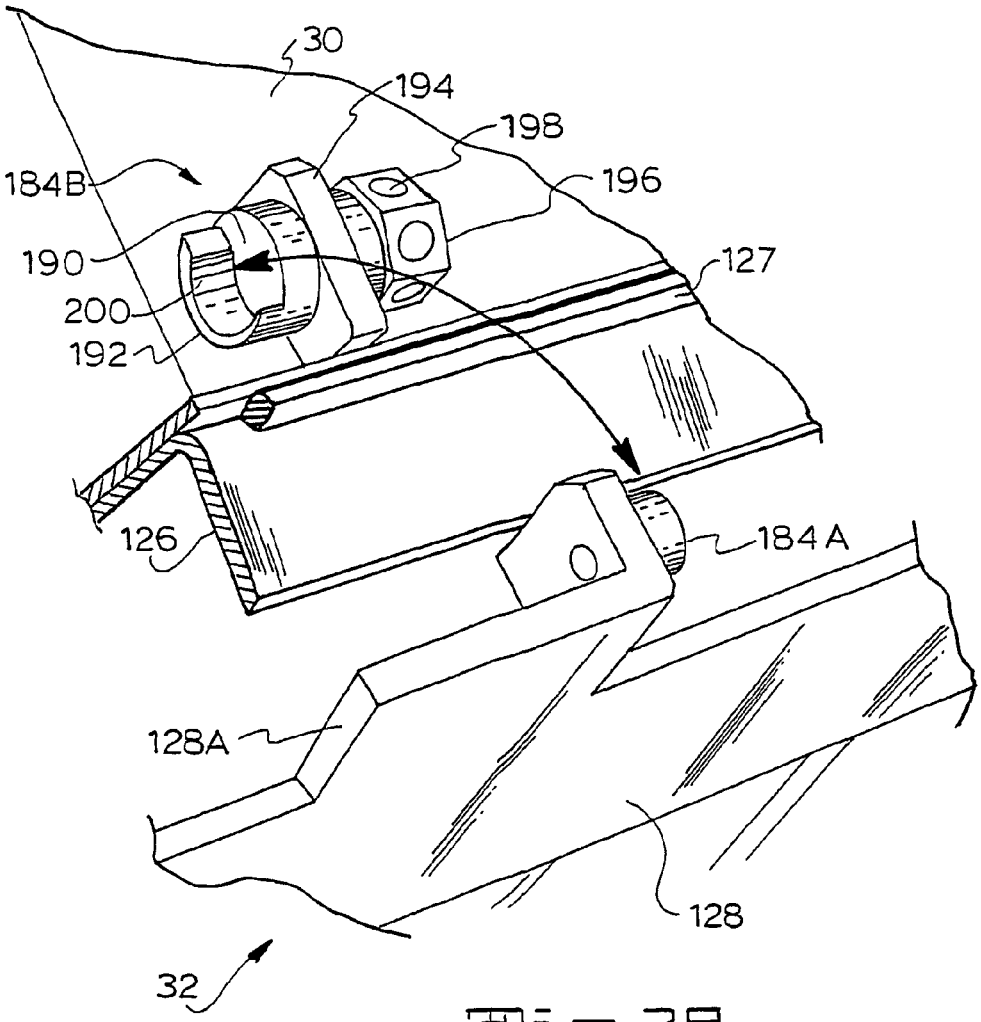
FIG. 29 shows the central tensioning elements shown in FIG. 27 in separation.

FIGS. 25 to 27 show details of the central hinge arrangement 34 of the embodiment shown in FIG. 24. As shown, the hinge arrangement 34 includes central hinges 114 spacedly arranged along the side covers 12 and 14. Each central hinge 114 is formed of spaced aligned sleeves 122 fixed to the upper section frame 30, spaced aligned sleeves 124 fixed to the lower section frame 32, a bridging plate 120 having enlarged ends 121 each configured to be accommodated between the respective spaced sleeves 122 and 124 and with a cavity to receive a pin 116/118 that extends through the sleeves 122 or 124.

As shown more clearly in FIGS. 26 and 27, the sleeves 122 are fixed to an L-shaped member 126 at the lower edge of the upper section frame 30, and the sleeves 124 are fixed to an L-shaped member 128 at the upper edge of the lower section frame 32. A sealing strip 127 is provided to seal the interior space 24 when the side covers 12 and 14 are in the erected position. In this embodiment, the sealing strip 127 extends along the lower edge of the upper section frames 30 and is arranged to be compressed by the L-shaped member 128 when the side covers 12 and 14 are in the erected position. The bridging members 120 and the L-shaped members 126 and 128 assist in distributing load between the side frame sections 30 and 32. The tensioning arrangement also assists in distributing load in the side covers 12 and 14.

Figure 28:
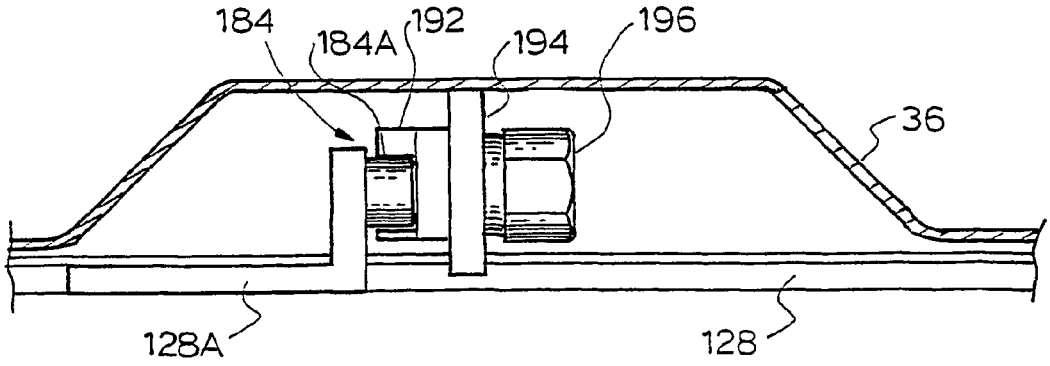
FIG. 28 is a partial section view of the side cover shown in FIG. 24 illustrating details of a pair of central tensioning elements for the tensioning arrangement in engagement with each other.
Figure 30:
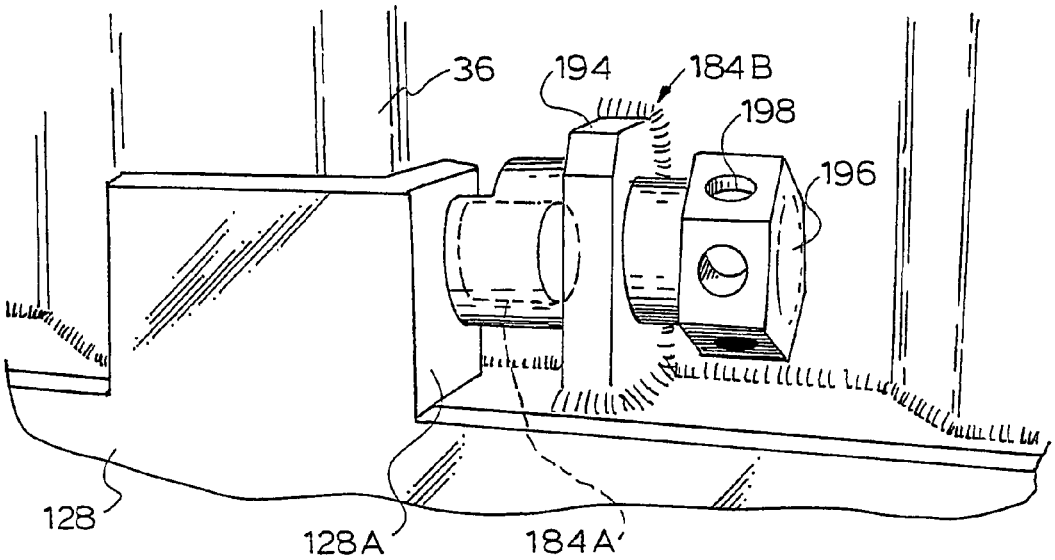
FIG. 30 shows the central tensioning elements shown in FIG. 29 being brought into engagement with each other.
Figure 31:
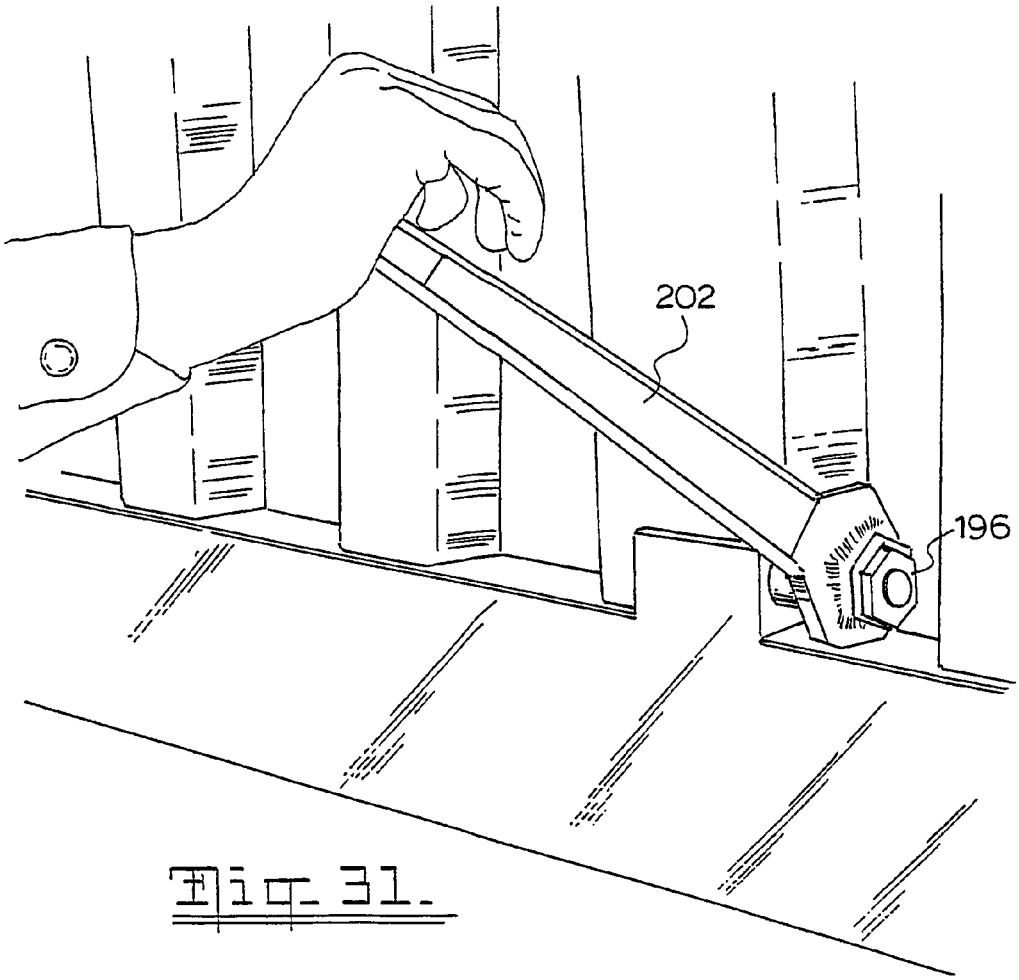
FIG. 31 shows a tool being used to vary tension of the lower tensioning elements shown in FIG. 30.

Turning to FIGS. 28 to 31, there are shown a pair of cooperating central elements 184 which are configured to be releaseably inter-fitted together. The elements 184 has a male part 184A fixed to an extension 128A of the L-shaped member 128, and a female part 184B fixed to the upper section frame 30 in a position to receive the male part 184A when the corresponding side cover 12 or 14 is in the erected position as shown in FIG. 28. In this example, the male part 184A is a pin arranged to be received in an open recess 190 formed in a curved portion 192 of the female part 184B. The female part 184B is rotatable mounted in a support plate 194 on the upper section frame 30, and has a polygonal shaped head 196 configured for a tool such as a shifter or spanner or wrench 202 to turn the female part 184B. Holes 198 may also be formed in the head 196 so that the female part 184B can be turned by a rod inserted in one of the holes 198. The curved portion 192 is formed with a cam surface 200 with a progressively increasing thickness from one end. The tension in a vertical direction along the side covers 12 and 14 can thus be varied by turning the tensioning elements 184. The tensioning elements 184 also assist in distributing load between the upper and lower section frames 30 and 32.

Figure 32:
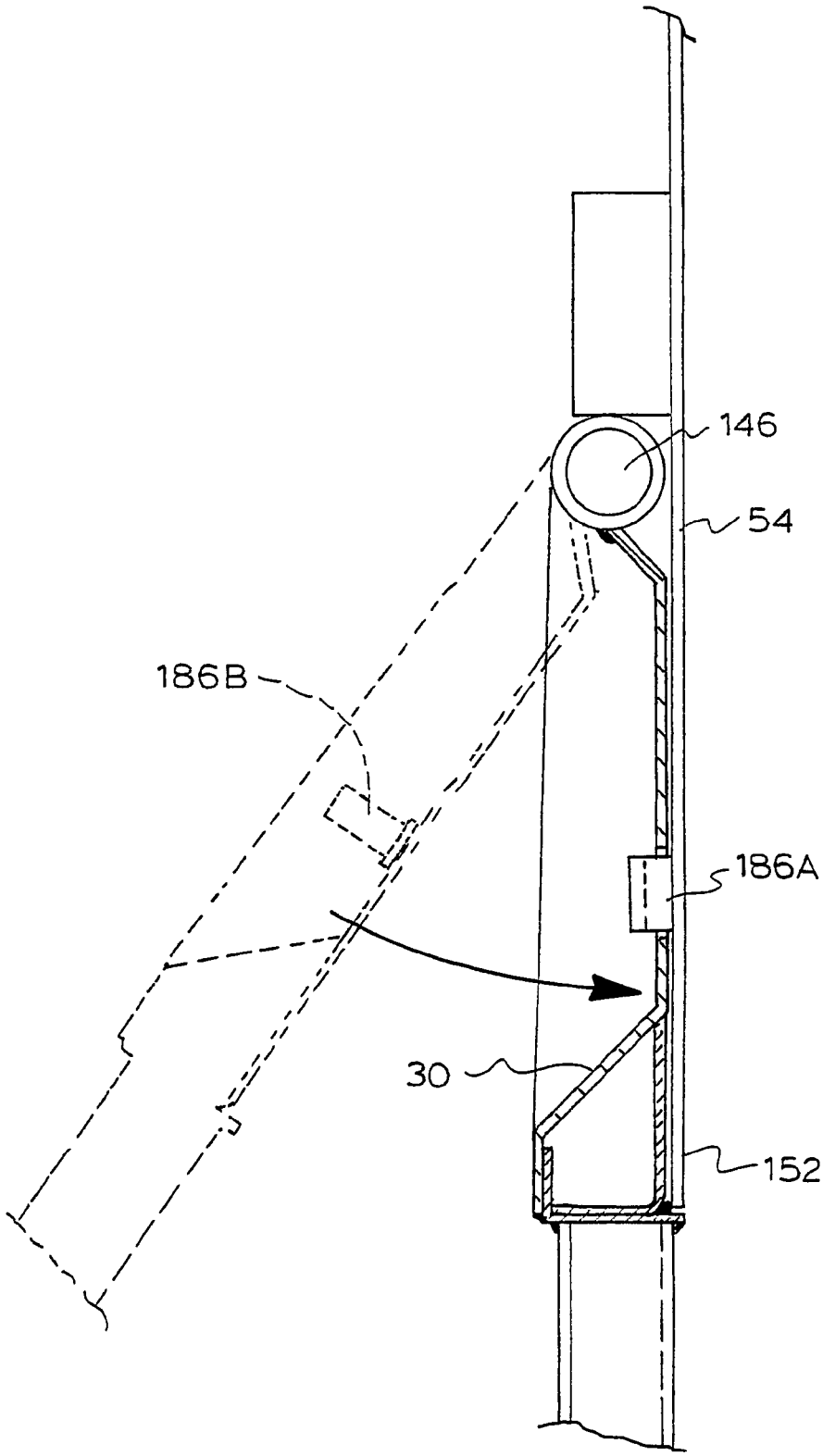
FIG. 32 is a partial section view of an upper section frame of the side cover shown in FIG. 24.
Figure 33:
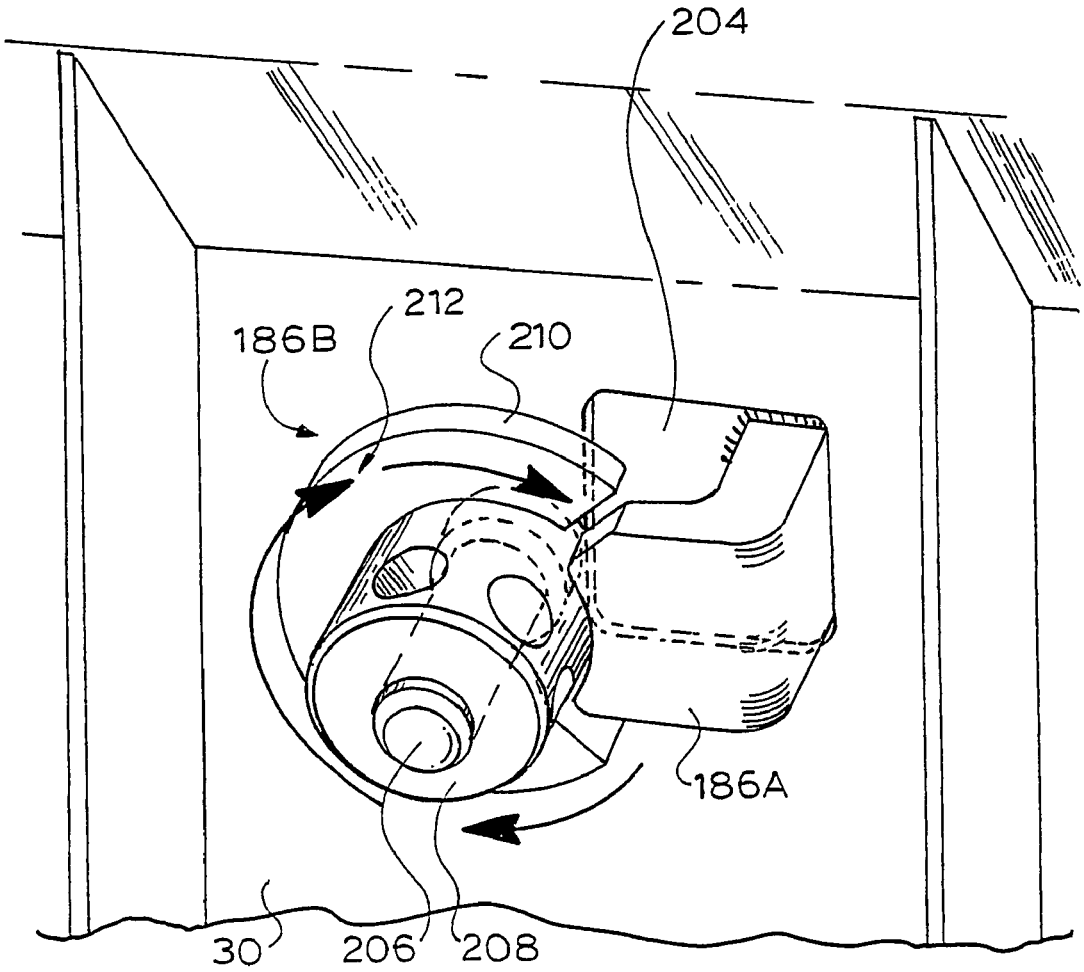
FIG. 33 is a partial view of the side cover shown in FIG. 32 illustrating details of a pair of upper tensioning elements for the tensioning arrangement in a process of engaging each other.

A pair of the upper tensioning elements 186 is shown in FIGS. 32 and 33. The elements 186 include an L-shaped stud 186A extending from the top skirting 54 and a cam part 186B rotatable mounted on the upper section frame 30. When the upper section frame 30 is in the erected position as shown in FIG. 33, the stud 186A extends through an opening 204 in the frame 30, and the cam part 186B can be turned to engage the stud 186A. In this example, the cam part 186B is rotatably mounted on a pin 206, and has a turnable head 208 with spaced holes for receiving a rod used to turn the head 208. Extending from the head 208 is a C-shaped peripheral flange 210 with a cam surface 212 arranged to engage the stud 186A. The cam surface 212 has an increasing thickness from one end so that the tension applied onto the engaging stud can be varied by turning the head 208. Accordingly, the upper section frame 30 is positively fixed to the upper skirting 54.

The paired lower tensioning elements 188 are connected to the base skirting 38 in a manner similar to the arrangement between the upper tensioning elements 186 and the upper skirting 54.

While not shown, it is understood that the upper skirtings 54 may have a slight bow when they are not subject to tension. Tensioning by the paired elements 184, 186 and 188 would effect in straightening the upper skirtings 54. Thus, the upper skirtings being formed of steel would apply a tension on the side covers 12 and 14 when in the erected position.

It should be noted that a sealing strip 152 is fixed along the upper section frame 30, The strip 152 seals a gap between the upper section frame 30 and the skirting 54 when the side covers 12 and 14 are in the erected position. Another sealing strip (not shown) in arranged to seal a gap between the lower section frame 32 and the base skirting 38 when the side covers 12 and 14 are in the erected position.

Figure 34:
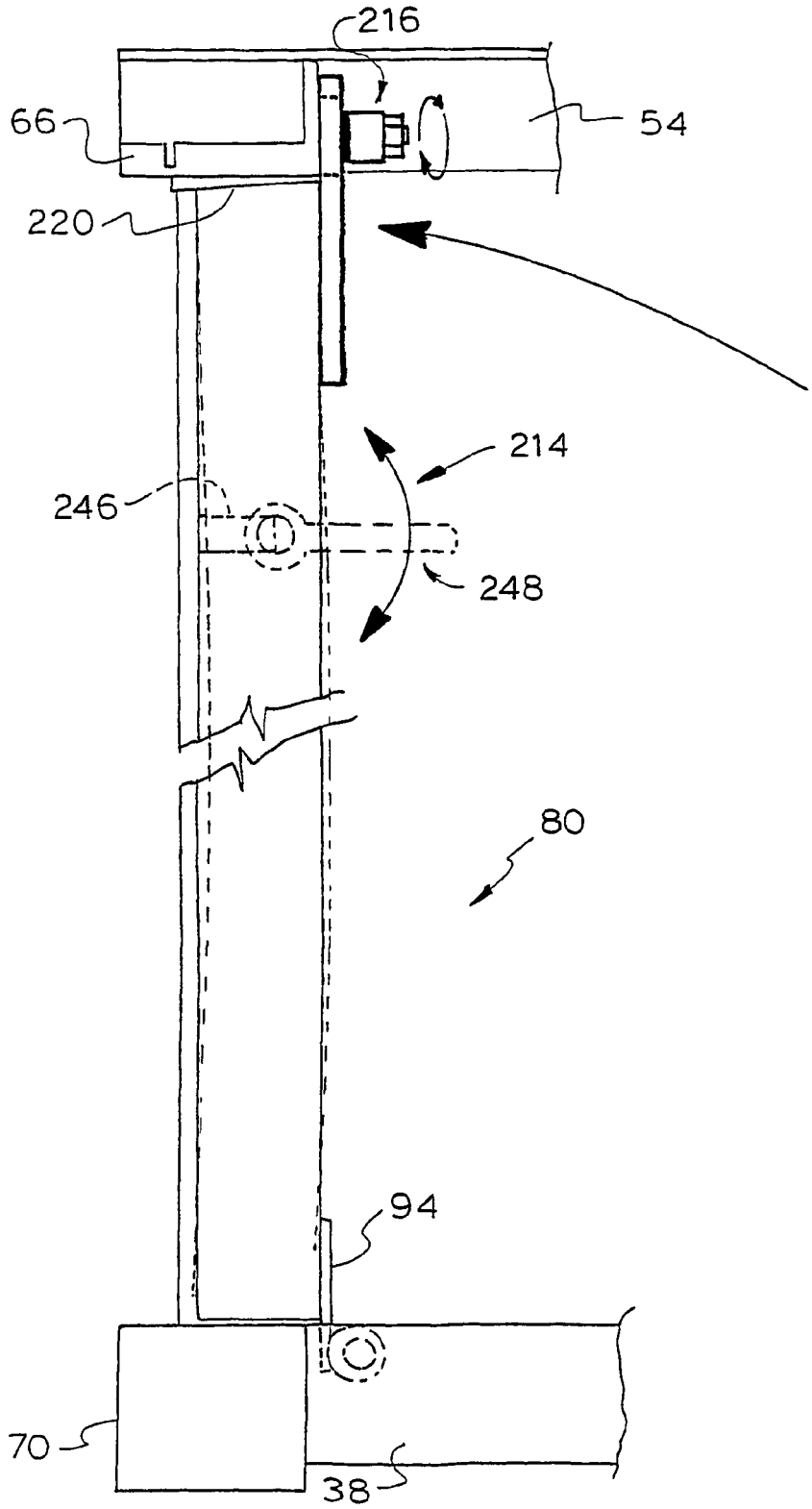
FIG. 34 is a partial section view of a post of an end cover with paired post tensioning elements for the tensioning arrangement.
Figure 35:
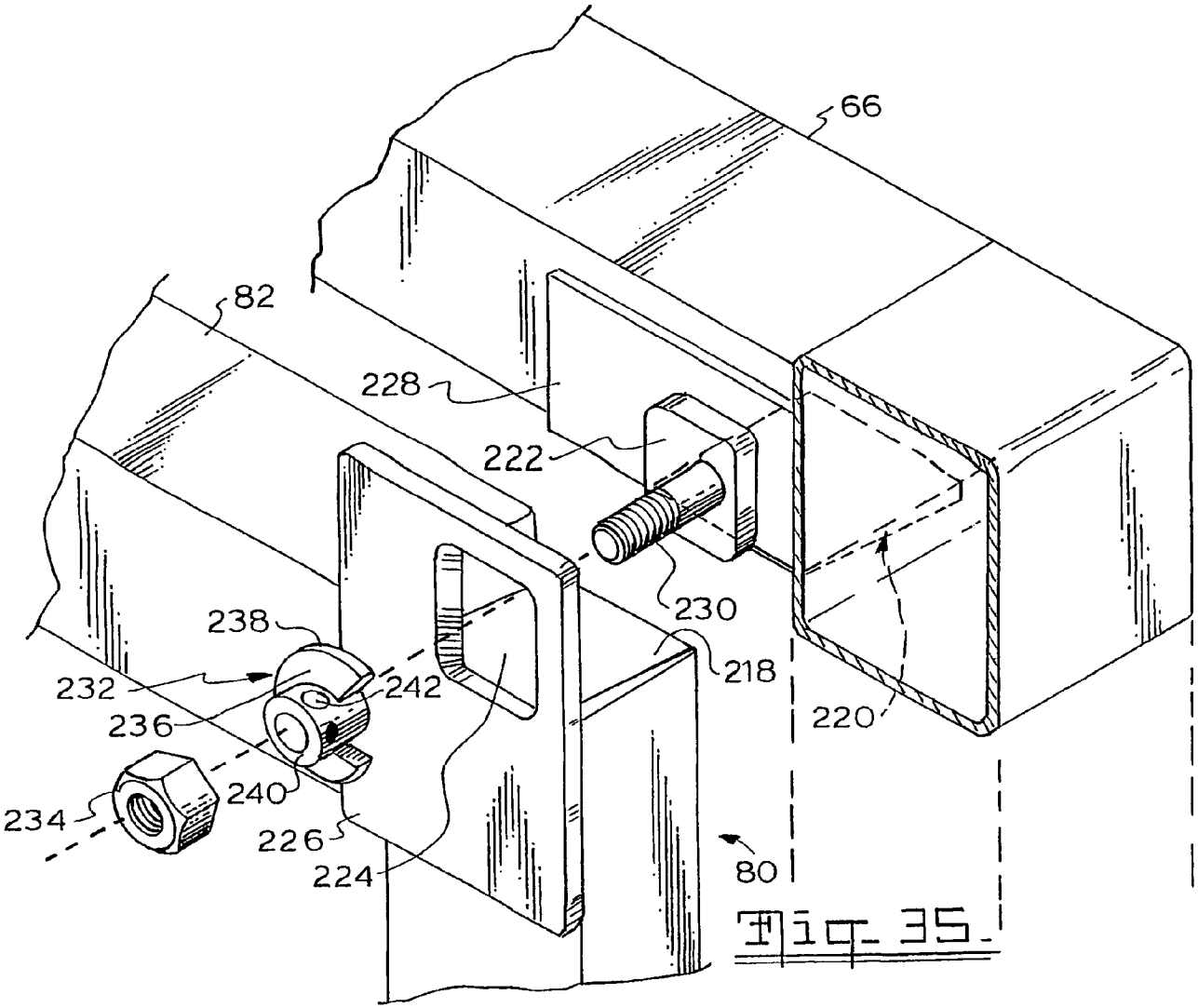
FIG. 35 shows details of the upper post tensioning elements shown in FIG. 33.

Referring to FIG. 34, the post 78,80 in this embodiment is also slightly bowed as shown in the dotted lines while in a relax state or when the corresponding end covers 16,18 is in the down position. The tensioning arrangement further includes paired intermediate tensioning elements 214 and paired top tensioning elements 216 for each post 78,80. When in the upright position, the posts 78 and 80 are straightened as shown in the solid lines in FIG. 34 by tensioning.

Each of the posts 78 and 80 for the end covers 18 and 20 has a bevelled top edge 218 for engaging a correspondingly bevelled wedge member 220 fixed to the cross member 66. Each pair of the elements 216 has a retaining block 222 configured to be accommodated in a hole 224 formed in a plate 226 which is fixed to the post 78/80. The block 222 is to a stiffening plate 228 on the cross member 66. When the end covers 16 and 18 are in the upright position, the block 220 of each pair of the top tensioning elements 216 is accommodated in the corresponding hole 224, and the bevelled surface 218 is in engagement with the wedge member 220. Each pair of the elements 216 has a threaded part 230 extending from the block 220, a cam part 232 rotatably mounted on the threaded part, and a threaded nut for adjustably securing the cam part in position on the threaded part. The cam part 232 has a flange 236 with a cam surface, and a head 240 with holes 242 arranged for receiving a rod serving as a lever for turning the cam part 232. The cam part 232 thus serves to vary the engagement point between the bevelled surface 218 and the wedge member 220, and thereby varying the tension along a vertical line on the end covers 16 and 18.

Figure 36:
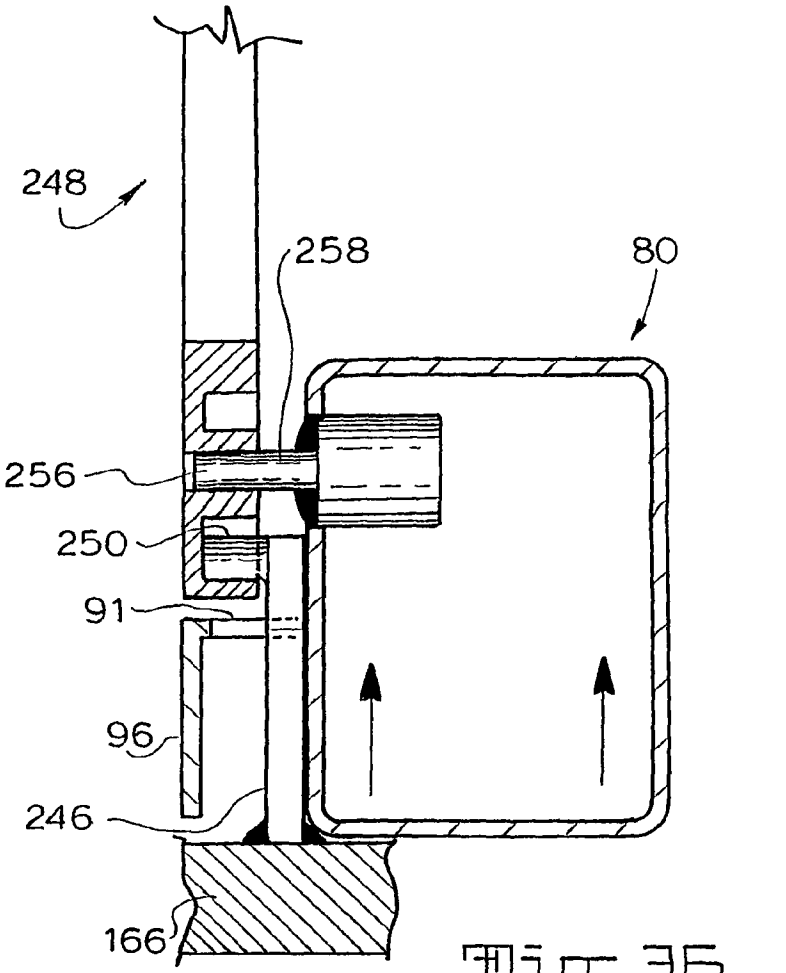
FIGS. 36 and 37 show details of the intermediate post tensioning elements shown in FIG. 33.
Figure 37:
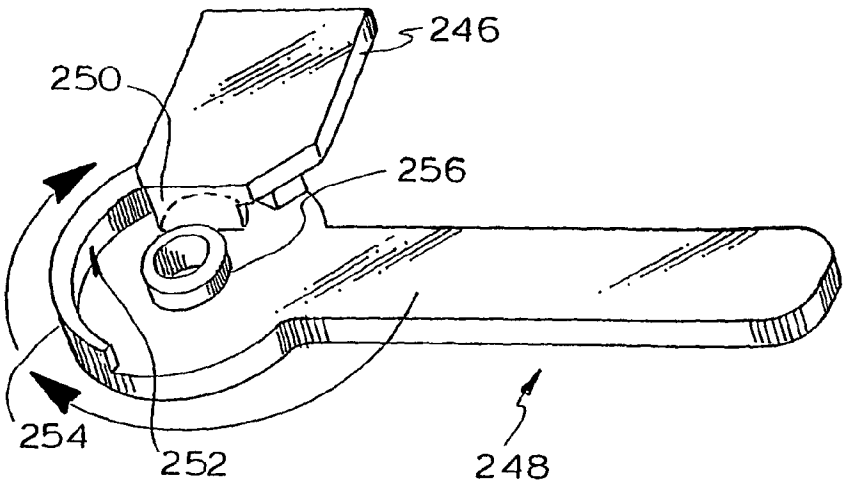

The paired intermediate tensioning elements 214 include a tongue 246 extending from the bent end 166 of an upper section frame 30, and a tensioning lever 248 arranged to engage the tongue 246 as shown in FIG. 34. Referring to FIG. 37, the tongue 246 has an in-turned edge 250 engaging a cam surface 252 of a substantially C-shaped projection 254 at one end of the lever 248. The cam surface 252 is configured to allow adjustment of the tension on the corresponding side cover 122/14 by turning the lever 248. The lever has a hub 256 arranged to receive a pin 258 extending from a post 78/80. The post includes flange 96 with holes 91 for the tongue 246 to pass therethrough when the post 78/80 is in the upright position. Thus the intermediate tensioning elements 214 apply a variable tension on the side covers 12 and 14 in the direction as shown by the arrow heads in FIG. 36.

Figure 38:
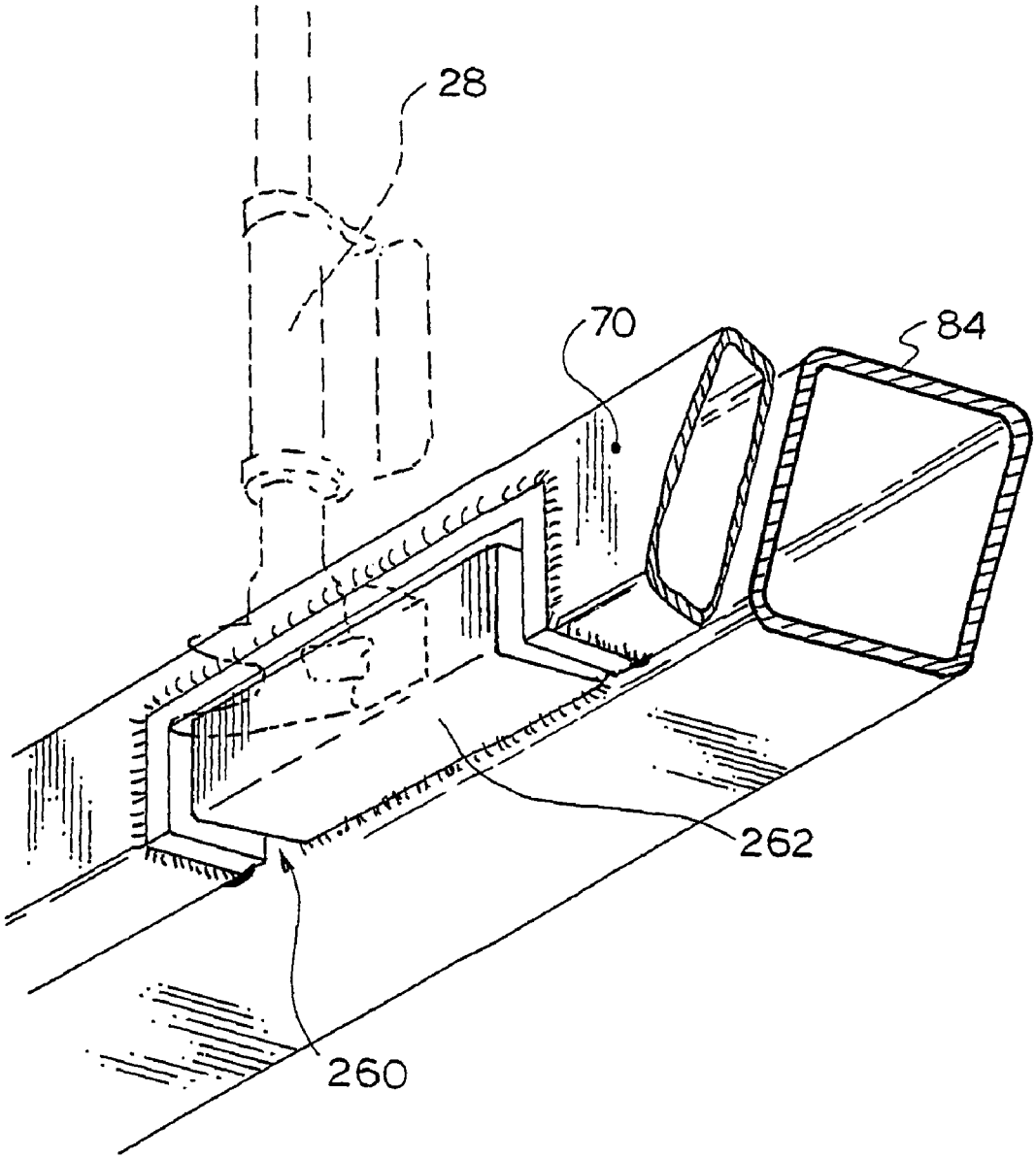
FIG. 38 is a partial perspective view showing one form of an end cover for the container according to the present invention.

In FIG. 38, the lower cross frame member 70 has a cut-out section 260 in which a L-shaped retaining member 262 is positioned. The recess section 262 serves to receive the lower latching end of a locking bar 28 on a door 26.

Whilst the above has been given by way of illustrative examples of the present invention, many variations and modifications thereto will be apparent to those skilled in the art without departing from the broad ambit and scope of the invention as herein set forth in the following claims.

The invention claimed is:

1. A collapsible container comprising a base structure, a top structure, opposed side covers arranged between the base structure and the top structure, each of said side covers having a lower section frame pivotally connected to said base structure and a top section frame pivotally connected to said top structure, and a central hinge arrangement fixed to the top and lower section frames of each of said side covers so that the top section frame is pivotally movable relative to the lower section frame, whereby the side covers are selectively positionable between an erected position in which the top structure is remote from the base structure and a collapsed position in which the top structure is at or adjacent to the base structure, in the erected position the container presenting an interior space between the base and top structures and between opposed open ends of the container, and end covers arranged to be pivotally movable between an upright position for covering respective open ends and a down position for allowing the side covers to be movable to the collapsed position, the central hinge arrangement being associated with central load distribution means arranged so that in the erected position load is distributed between the upper and lower section frames of each side cover, the central load distribution means including a central load transfer member having opposed ends, one end thereof being fixed to or integrally formed with one of said top and lower section frames, and the other end thereof being arranged to engage and be locked to the other of said top and lower section frames when the container is in the erected position, and a tensioning arrangement for tensioning the side covers in the erected position;

the tensioning arrangement including first tensioning means having one or more paired tensioning elements configured to move into a position where they engage each other when the side covers are being moved into the erected position to thereby tension each side cover in a substantially vertical direction traversing each side cover.

2. The container according to claim 1 wherein the first tensioning means is arranged to tension the side covers in a substantially horizontal direction along the side covers.

3. The container according to claim 1 wherein the first tensioning means has one or more paired central tensioning elements arranged on each of said side covers to tension each said side cover in said substantially vertical direction, the one or more paired central tensioning elements are respectively fixed to the top and lower section frames and are configured to move into a position to engage each other to thereby tension said each side cover when said side covers are in the erected position.

4. The container according to claim 3 wherein said one or more paired tensioning elements comprise one or more paired upper tensioning elements and one or more paired lower tensioning elements for each said side cover, the one or more paired upper tensioning elements being respectively fixed to the top section frame and the top structure, and being configured to engage each other to thereby tension said each side cover, the one or more paired lower tensioning elements being respectively fixed to the lower section frame and the base structure, and being configured to engage each other to thereby tension said each side cover.

5. The container according to claim 4 wherein said first tensioning means having sets of said paired tensioning elements spacedly arranged along each side cover, and each set including one pair of the central tensioning elements and one pair of the upper and/or lower tensioning elements.

6. The container according to claim 4 wherein the paired central tensioning elements are arranged so that the tension on each side cover is variably adjustable.

7. The container according to claim 3 wherein one of said paired central tensioning elements is a projection, and the other of said paired central tensioning elements is rotatable and has a recess with a cam surface configured to engage the projection when it is in the recess, the cam surface being shaped to vary said tension when said other of said paired central tensioning elements is rotated.

8. The container according to claim 4 wherein one of said paired lower and/or the upper tensioning elements is a projection, and the other of said paired lower and/or the upper paired tensioning elements is rotatable and has a recess with a cam surface configured to engage the projection when it is in the recess, the cam surface being shaped to vary said tension when said other of said paired central tensioning elements is rotated.

9. The container according to claim 7 wherein the projection is in the form of a pin or a hook.

10. The container according to claim 1 wherein the central hinge arrangement for each side cover includes at least one pair of a first central hinge element fixed to the top section frame and a second central hinge element fixed to the lower section frame, and a bridging member provided for the or each pair of the first and second hinge elements, the or each bridging member having compatible hinge elements at ends thereof and the compatible hinge elements are arranged to cooperate with respective paired first and second hinge elements for the top section frame to be pivotally movable relative to the lower section frame.

11. The container according to claim 10 wherein the central load distribution means being associated with the or each of said paired first and second hinge elements so as to distribute load between the top and lower section frames when the container is in the erected position.

12. The container according to claim 10 wherein the central load transfer member for the or each of said paired first and second hinge elements.

13. The container according to claim 12 wherein the central load transfer member is configured to extend between ends of a respectively side cover.

14. The container according to claim 12 wherein the tensioning arrangement being arranged to be selectively positionable to maintain the central load transfer member in engagement the other of said first and second top and lower section frames when the container is in the erected position.

15. The container according to claim 10 wherein the top section frame of each side cover having a load bar arranged to engage a clamping plate extending from the bridging member when the container is in the erected position.

16. The container according to claim 15 wherein the load bar is arranged to engage the central load transfer member while the container is in the erected position.

17. The container according to claim 1 wherein each side cover having one or more panels arranged to cover each of the top and lower section frames.

18. The container according to claim 17 wherein the one or more panels having a corrugated or wavy profile.

19. The container according to claim 1 wherein the top structure having a top skirting along each side thereof and the top skirting is arranged in pivotal connection with the top section frame.

20. The container according to claim 19 wherein further comprising at least one top hinge arranged to pivotally connect the top skirting with the top section frame.

21. The container according to claim 20 wherein further comprising top load distribution means arranged in association with the at least one top hinge to distribute load between the top skirt and the top section frame.

22. The container according to claim 21 wherein the top load distribution means having one or more top load bearing bars associated with the or each said at least one top hinge.

23. The container according to claim 22 wherein the tensioning arrangement is arranged to lock one or more of the one or more top load bearing bars in position.

24. The container according to claim 20 wherein the top section frame having at least one upper gusset and the at least one top hinge having a first top hinge element fixed to respective upper gusset and a compatible second top hinge element fixed to the top skirting.

25. The container according to claim 1 wherein the base structure having a base skirting along each side thereof and the base skirting is arranged in pivotal connection with the lower section frame.

26. The container according to claim 25 wherein further comprising at least one lower hinge arranged to pivotally connect the base skirting with the lower section frame.

27. The container according to claim 26 wherein further comprising base load distribution means arranged in association with the at least one lower hinge to distribute load between the base skirt and the lower section frame.

28. The container according to claim 27 wherein the base load distribution means having one or more lower load bearing bars associated with the or each said at least one lower hinge.

29. The container according to claim 28 wherein the tensioning arrangement is arranged to lock one or more of the one or more lower load bearing bars in position.

30. The container according to claim 26 wherein the lower section frame having at least one lower gusset and the at least one lower hinge having a first lower hinge element fixed to respective lower gusset and a compatible second lower hinge element fixed to the base skirting.

31. The container according to claim 1 wherein the central hinge arrangement includes a plurality of paired first and second hinge elements, and the container includes a number of top hinges and a like number lower hinges arranged in substantial alignment with corresponding paired first and second hinge elements.

32. The container according to claim 1 wherein each side cover includes a sealing arrangement having top sealing means for sealing between the top structure and the top section frame, and lower sealing means for sealing between the base structure and the lower section frame.

33. The container according to claim 32 wherein the central hinge arrangement also having central sealing means for sealing between the top and lower section frames.

34. The container claim 25 wherein the base structure having pockets configured to receive forks of a lifting device.

35. The container according to claim 34 wherein each said pockets are formed of a hollow tubular member extending between the base skirtings.

36. The container according to claim 35 wherein the base structure includes reinforcement means fixed to the base skirtings and arranged to reinforce structural strength of the hollow tubular members.

37. The container according to claim 25 wherein the base structure has a number of spaced cross members with ends thereof fixed to the base skirtings and a floor supported by the base cross members.

38. The container according to claim 1 wherein the container having an open or closed top structure.

39. The container according to claim 38 wherein the closed top structure having a number of spaced cross members with ends thereof fixed to the top skirtings and a top cover supported by the top cross members.

40. The container claim 1 wherein further comprising base corner fittings and top corner fittings arranged respectively at corners of the base structure and the top structure.

41. The container according to claim 40 wherein each of the top and base corner fittings have at least one hole arranged to receive a container locking pin for locking to another container thereon or thereunder.

42. The container according to claim 1 wherein at least one of the end covers is biassed to move to its down position and/or upright position.

43. The container according to claim 1 wherein each said end covers having spaced posts with a cover member spanning the posts.

44. The container according to claim 43 wherein one or each said cover members are formed of openable door panels.

45. The container according to claim 43 wherein the tensioning arrangement further including second tensioning means arranged to tension each side cover in a substantially horizontal direction traversing the end covers.

46. The container according to claim 45 wherein the second tensioning means including one or more paired tensioning elements, one element of a paired tensioning elements being fixed to one of said posts and the other element of the paired tensioning elements being fixed to one of said side covers, and arranged to engage with each other when the end covers are in the upright position, whereby the side covers are in tension.

47. The container according to claim 46 wherein each tensioning element on the posts having a cam surface arranged to be positionable to engage the other element on the side cover in the engaged position.

48. The container according to claim 47 wherein the paired tensioning elements are configured to be adjustable for varying tension on the side walls.

49. The container according to claim 46 wherein each post including a flange formed with said one tensioning elements, and each said side cover including end flanges formed with said other tensioning elements of the paired tensioning elements.

50. The container according to claim 49 wherein said one tensioning element(s) is configured as an aperture(s) and said other tensioning element(s) is configured as a hook(s) arranged to fit in the corresponding aperture(s) when the end covers are in the upright position.

51. The container according to claim 45 wherein each of the posts having a lower end and an upper end, the second tensioning means including a load bearing plate arranged at the lower end of each post and a positioning element arranged at the upper end of each post, the load bearing plates of the posts being configured to engage with corresponding side covers when the end covers are in the upright position, and the positioning elements of the posts being configured to engage with complimentary positioning elements on the top structure when the end covers are in the upright position, the load bearing plates and the positioning elements being arranged to place the side covers in tension in a vertical direction.

52. The container according claim 1 wherein the top structure is configured with a slight bow when the side covers are in the collapsed position, and the tensioning arrangement is arranged to cause the top structure to be substantially level when the side covers are under tension in the erected position.

53. The container according to claim 1 wherein each end cover having spaced posts which are configured with a slight bow when in the down position, and the tensioning arrangement is arranged to cause the posts to be substantially straight when they are under tension in the upright position.

* * * * *